US007188931B2

(12) United States Patent
Cabal et al.

(10) Patent No.: US 7,188,931 B2
(45) Date of Patent: Mar. 13, 2007

(54) DOUBLY-ANCHORED THERMAL ACTUATOR HAVING VARYING FLEXURAL RIGIDITY

(75) Inventors: Antonio Cabal, Webster, NY (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 254 days.

(21) Appl. No.: 10/994,686

(22) Filed: Nov. 22, 2004

(65) Prior Publication Data

US 2006/0109309 A1 May 25, 2006

(51) Int. Cl.
*B41J 2/04* (2006.01)

(52) U.S. Cl. ..... 347/54; 347/56; 347/65

(58) Field of Classification Search ..... 347/20, 347/44, 54, 56, 61–65, 67–68, 70–71; 310/306–307; 337/139–141; 60/527–529
See application file for complete search history.

(56) References Cited

U.S. PATENT DOCUMENTS

| | | | | |
|---|---|---|---|---|
| 3,747,120 | A | 7/1973 | Stemme | 347/70 |
| 3,946,398 | A | 3/1976 | Kyser et al. | 439/599 |
| 4,296,421 | A | 10/1981 | Hara et al. | 347/48 |
| 5,599,695 | A | 2/1997 | Pease et al. | 435/91.1 |
| 5,684,519 | A | 11/1997 | Matoba et al. | 347/54 |
| 5,754,205 | A | 5/1998 | Miyata et al. | 347/70 |
| 5,771,882 | A | 6/1998 | Psaros et al. | 128/203.12 |
| 5,785,295 | A | 7/1998 | Tsai | 417/413.3 |
| 5,902,648 | A | 5/1999 | Naka et al. | 427/558 |
| 5,922,218 | A | 7/1999 | Miyata et al. | 216/27 |
| 6,067,797 | A | 5/2000 | Silverbrook | 60/528 |
| 6,087,638 | A | 7/2000 | Silverbrook | 219/540 |
| 6,168,395 | B1 | 1/2001 | Quenzer et al. | 251/129.01 |
| 6,180,427 | B1 | 1/2001 | Silverbrook | 438/21 |
| 6,254,793 | B1 | 7/2001 | Silverbrook | 216/27 |

(Continued)

FOREIGN PATENT DOCUMENTS

| | | |
|---|---|---|
| EP | 1 362 702 | 11/2003 |

*Primary Examiner*—Juanita D. Stephens
(74) *Attorney, Agent, or Firm*—Stephen Pond Consulting

(57) ABSTRACT

A doubly-anchored thermal actuator for a micro-electromechanical device such as a liquid drop emitter or a fluid control microvalve is disclosed. The thermal actuator is comprised of a base element formed with a depression having opposing anchor. A deformable element, attached to the base element at the opposing anchor edges, is constructed as a planar lamination including a first layer of a first material having a low coefficient of thermal expansion and a second layer of a second material having a high coefficient of thermal expansion. The deformable element has anchor portions adjacent the anchor edges and a central portion between the anchor portions wherein the flexural rigidity of the anchor portions is substantially less than the flexural rigidity of the central portion. The doubly-anchored thermal actuator further comprises apparatus adapted to apply a heat pulse to the deformable element that causes a sudden rise in the temperature of the deformable element. The deformable element bows outward in a direction toward the second layer, and then relaxes to a residual shape as the temperature decreases. The doubly-anchored thermal actuator is configured with a liquid chamber having a nozzle or a fluid flow port to form a liquid drop emitter or a fluid control microvalve, or to activate an electrical microswitch. Heat pulses are applied to the deformable element by resistive heating or by light energy pulses.

34 Claims, 27 Drawing Sheets

U.S. PATENT DOCUMENTS

| | | | | |
|---|---|---|---|---|
| 6,274,056 | B1 | 8/2001 | Silverbrook | 347/54 |
| 6,345,424 | B1 | 2/2002 | Hasegawa et al. | 29/890.1 |
| 6,481,821 | B1 * | 11/2002 | Yun et al. | 347/20 |
| 6,561,627 | B2 | 5/2003 | Jarrold et al. | 347/54 |
| 6,598,960 | B1 | 7/2003 | Cabal et al. | 347/56 |
| 6,631,979 | B2 | 10/2003 | Lebens et al. | 347/54 |
| 6,869,169 | B2 * | 3/2005 | Cabal et al. | 347/56 |
| 2003/0214556 | A1 | 11/2003 | Cabal et al. | 347/54 |

* cited by examiner

DOUBLY-ANCHORED THERMAL ACTUATOR HAVING VARYING FLEXURAL RIGIDITY

Reference is made to commonly assigned, U.S. patent application Ser. No. 10/994,952 filed concurrently herewith, entitled "DOUBLY-ANCHORED THERMAL ACTUATOR HAVING VARYING FLEXURAL RIGIDITY, in the name of Antonio Cabal, et al.; and U.S. patent application Ser. No. 10/999,645, filed concurrently herewith, entitled "DOUBLY-ANCHORED THERMAL ACTUATOR HAVING VARYING FLEXURAL RIGIDITY, in the name of Antonio Cabal, et al, the disclosures of which are incorporated herein by reference.

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices. Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120.

Miyata et al. in U.S. Pat. Nos. 5,754,205 and 5,922,218 disclose an efficient configuration of a piezoelectrically activated ink jet drop generator. These disclosures teach the construction of a laminated piezoelectric transducer by forming a flexible diaphragm layer over a rectangular drop generator liquid pressure chamber and then forming a plate-like piezoelectric expander over the diaphragm in registration with the rectangular chambers. Experiment data disclosed indicates that the amount of deflection of the piezoelectric laminate will be greater if the piezoelectric plate is somewhat narrower than the width of rectangular opening to the pressure chamber being covered by the diaphragm layer. The Miyata '205 and Miyata '218 disclosures are directed at the use of silicon substrates cut along a (110) lattice plane and wherein the pressure chambers are arranged along a <112> lattice direction.

A currently popular form of ink jet printing, thermal ink jet (or "bubble jet"), uses electroresistive heaters to generate vapor bubbles which cause drop emission, as is discussed by Hara et al., in U.S. Pat. No. 4,296,421. Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission and micro fluid valving is needed that can be used with a broad range of liquid formulations. Apparatus are needed which combine the advantages of microelectronic fabrication used for thermal ink jet with the liquid composition latitude available to piezo-electro-mechanical devices.

A DOD ink jet device which uses a thermo-mechanical actuator was disclosed by Matoba, et al in U.S. Pat. No. 5,684,519. The actuator is configured as a thin beam constructed of a single electroresistive material located in an ink chamber opposite an ink ejection nozzle. The beam buckles due to compressive thermo-mechanical forces when current is passed through the beam. The beam is pre-bent into a shape bowing towards the nozzle during fabrication so that the thermo-mechanical buckling always occurs in the direction of the pre-bending.

K. Silverbrook in U.S. Pat. Nos. 6,067,797; 6,087,638; 6,239,821 and 6,243,113 has made disclosures of a thermo-mechanical DOD ink jet configuration. Methods of manufacturing thermo-mechanical ink jet devices using microelectronic processes have been disclosed by K. Silverbrook in U.S. Pat. Nos. 6,180,427; 6,254,793 and 6,274,056. The thermal actuators disclosed are of a bi-layer cantilever type in which a thermal moment is generated between layers having substantially different coefficients of thermal expansion. Upon heating, the cantilevered microbeam bends away from the layer having the higher coefficient of thermal expansion; deflecting the free end and causing liquid drop emission.

Several disclosures have been made of thermo-mechanical actuators utilizing especially effective materials combinations including intermetallic titanium aluminide as a thermally expanding electroresistive layer choice. These disclosures include Jerrold, et al. in U.S. Pat. No. 6,561,627; Lebens, et al. in U.S. Pat. No. 6,631,979; and Cabal, et al. in U.S. Pat. No. 6,598,960. The latter two U.S. patents further disclose cantilevered thermal actuators having improved energy efficiency achieved by heating a partial length of the beam actuator.

Cabal, et al., disclosed a doubly-anchored beam style thermal actuator operating in a "snap-through" mode in pre-grant publication US 2003/0214556. In this disclosure it is taught that a snap-through mode may be realized by anchoring the beam in a semi-rigid fashion.

Thermo-mechanically actuated drop emitters are promising as low cost devices which can be mass produced using microelectronic materials and equipment and which allow operation with liquids that would be unreliable in a thermal ink jet device. Large and reliable force actuations can be realized by thermally cycling bi-layer configurations. However, operation of thermal actuator style drop emitters, at high drop repetition frequencies, requires careful attention to the energy needed to cause drop ejection in order to avoid excessive heat build-up. The drop generation event relies on creating a large pressure impulse in the liquid at the nozzle. Configurations and designs that maximize the force and volume displacement may therefore operate more efficiently and may be useable with fluids having higher viscosities and densities.

Binary fluid microvalve applications benefit from rapid transitions from open to closed states, thereby minimizing the time spent at intermediate pressures. A thermo-mechanical actuator with improved energy efficiency will allow more frequent actuations and less energy consumption when held in an activated state. Binary microswitch applications also will benefit from the same improved thermal actuator characteristics, as would microvalves.

A useful design for thermo-mechanical actuators is a beam, or a plate, anchored at opposing edges to the device structure and capable of bowing outward at its center, providing mechanical actuation that is perpendicular to the nominal rest plane of the beam or plate. A thermo-mechanical beam that is anchored along at least two opposing edges will be termed doubly-anchored thermal actuators. Such a configuration for the moveable member of a thermal actuator will be termed a deformable element herein and may have a variety of planar shapes and amount of perimeter anchoring, including anchoring fully around the perimeter of the deformable element. It is intended that all such multiply-anchored deformable elements are anticipated configurations of the present inventions and are included within the term "doubly-anchored."

The deformation of the deformable element is caused by setting up thermal expansion effects within the plane of the deformable element. Both bulk expansion and contraction of the deformable element material, as well as gradients within the thickness of the deformable element, are useful in the design of thermo-mechanical actuators. Such expansion gradients may be caused by temperature gradients or by actual materials changes, layers, thru the deformable element. These bulk and gradient thermo-mechanical effects may be used together to design an actuator that operates by buckling in a predetermined direction with a predetermined magnitude of displacement.

Doubly-anchored thermal actuators, which can be operated at acceptable peak temperatures while delivering large force magnitudes and accelerations, are needed in order to build systems that operate with a variety of fluids at high frequency and can be fabricated using MEMS fabrication methods. Design features that significantly improve energy efficiency are useful for the commercial application of MEMS-based thermal actuators and integrated electronics.

SUMMARY OF THE INVENTION

It is therefore an object of the present invention to provide a doubly-anchored thermal actuator that provides large force magnitudes and accelerations and which does not require excessive peak temperatures.

It is also an object of the present invention to provide a liquid drop emitter, which is actuated by a doubly-anchored thermal actuator.

It is also an object of the present invention to provide a fluid microvalve, which is actuated by a doubly-anchored thermal actuator.

It is also an object of the present invention to provide an electrical microswitch, which is actuated by a doubly-anchored thermal actuator.

The foregoing and numerous other features, objects and advantages of the present invention will become readily apparent upon a review of the detailed description, claims and drawings set forth herein. These features, objects and advantages are accomplished by constructing a doubly-anchored thermal actuator for a micro-electromechanical device comprising a base element formed with a depression having opposing anchor edges. A deformable element, attached to the base element at the opposing anchor edges and residing in a first position, is constructed as a planar lamination including a first layer of a first material having a low coefficient of thermal expansion and a second layer of a second material having a high coefficient of thermal expansion. The deformable element has anchor portions adjacent the anchor edges, and a central portion between the anchor portions, wherein the flexural rigidity of the anchor portions is substantially less than the flexural rigidity of the central portion. The doubly-anchored thermal actuator further comprises apparatus adapted to apply a heat pulse to the deformable element that causes a sudden rise in the temperature of the deformable element. The deformable element bows outward in a direction toward the second layer to a second position, and then relaxes to the first position as the temperature decreases.

The present invention is particularly useful as a thermal actuator for liquid drop emitters used as printheads for DOD ink jet printing. In this preferred embodiment the doubly-anchored thermal actuator resides in a liquid-filled chamber that includes a nozzle for ejecting liquid. Application of a heat pulse to the deformable element of the doubly-anchored thermal actuator causes rapid bowing in the direction towards the nozzle direction forcing liquid from the nozzle.

The present invention is useful as a thermal actuator for fluid microvalves used in fluid metering devices or systems needing rapid pressure switching. In this preferred embodiment a doubly-anchored thermal actuator resides in a fluid-filled chamber that includes a fluid flow port. The doubly-anchored actuator acts to close or open the fluid flow port for normally open valve or normally closed valve embodiments of the present inventions. Application of a heat pulse to the deformable element of the doubly-anchored thermal actuator initially causes a buckling that is configured to open or close the fluid flow port.

The present invention is also useful as a thermal actuator for electrical microswitches used to control electrical circuits. In this preferred embodiment a doubly-anchored thermal actuator activates a control electrode that makes or breaks contact with switch electrodes to open or close an external circuit. Application of a heat pulse to the deformable element of the doubly-anchored thermal actuator causes a buckling that is configured to open or close the microswitch.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a doubly-anchored thermal actuator, a drop-on-demand liquid emission device, normally closed and normally open microvalves, and normally closed and normally open microswitches. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators having improved drop ejection performance for a wide range of fluid properties. The inventions further provide microvalves and microswitches with improved energy efficiency.

The inventors of the present inventions have discovered that a clamped, or doubly-anchored, deformable element type micro thermal actuator may be designed to have significantly improved energy efficiency if the flexural rigidity of the deformable element is reduced in portions near the anchoring edges. Upon heating, a multi-layer deformable element bows the direction of the layer of highest thermal expansion. By confining the heating to a central portion and reducing the flexural rigidity of the deformable element near the places and edges where it is clamped, more deflection is achieved for a given amount of thermal input energy.

Figure 1A:
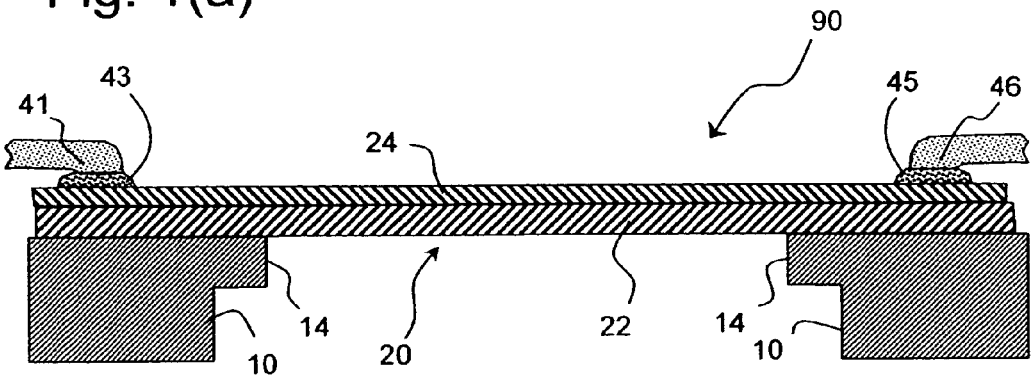
FIG. 1 is a side view illustration of two positions of a doubly-anchored thermal actuator.
Figure 1B:
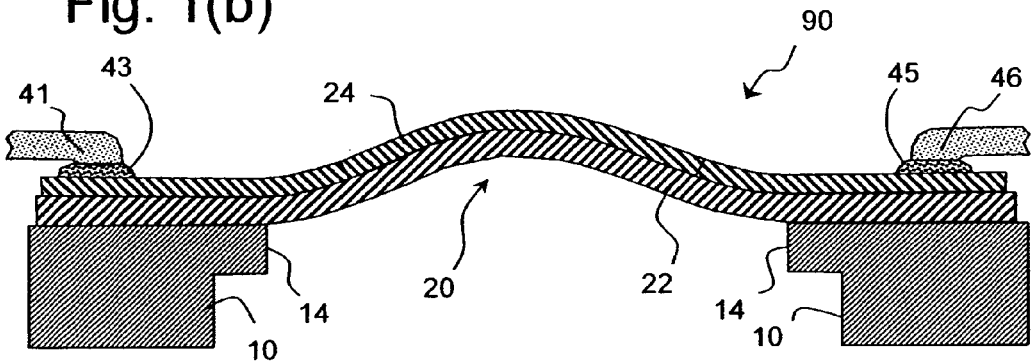

FIG. 1 illustrates in side view a conventional doubly-anchored thermal actuator. A deformable element 20 is anchored to a base element 10 at two opposing anchor edges 14. The illustrated deformable element is a thin beam comprised of two layers first layer 22 and second layer 24. First layer 22 is constructed of a material having a low coefficient of thermal expansion, such as a silicon oxide or nitride. Second layer 24 is constructed of a material having a high coefficient of thermal expansion such as a metal. FIG. 1(*a*) shows the deformable element 20 at rest at a nominal operating temperature. In the illustrated conventional thermal actuator the second material is an electroresistive metal such as titanium aluminide that is self-heating when a current is passed through layer 24 via electrical connections illustrated as solder bumps 43, 45 and TAB bond leads 41,46. Heating the deformable element by an applied current causes it to deform (bow or buckle) in a direction towards the more thermally expansive layer 24 as illustrated in FIG. 1(*b*).

Figure 2A:
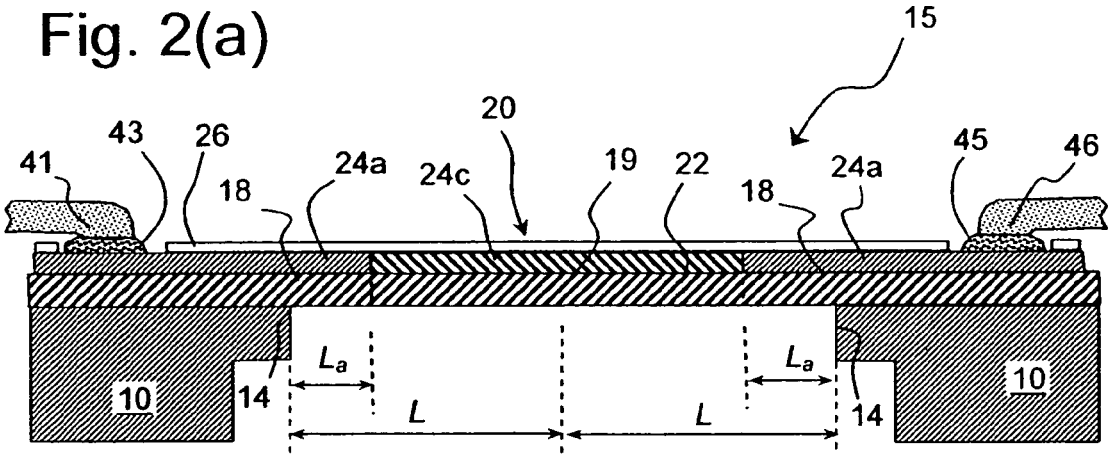
FIG. 2 is a side view illustration of two positions of a doubly-anchored thermal actuator according to the present invention.
Figure 2B:
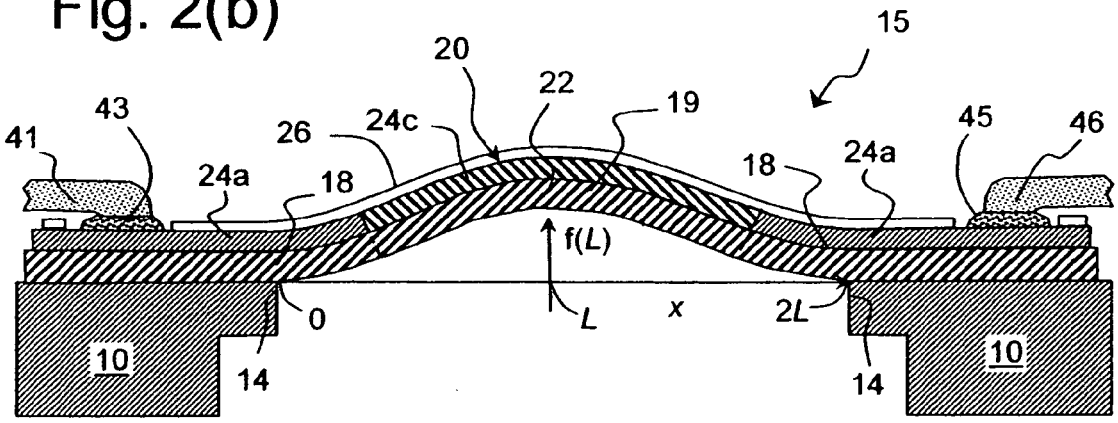

FIGS. 2(*a*) and 2(*b*) illustrate in side views a doubly-anchored thermal actuator 15 according to the present inventions. In FIG. 2(*a*) the doubly-anchored thermal actuator is at a quiescent first position. In FIG. 2(*b*) the deformable element has been heated by passing current through electroresistive material in second layer 24, raising the temperature, and causing the deformable element to bow or buckle into a second equilibrium shape. The second layer 24 is illustrated to have anchor portions 24*a* and a central portion 24*c*. An important aspect of the present inventions is that the flexural rigidity of the deformable element is reduced in the anchor portions 18 near anchor edges 14 with respect to the flexural rigidity of the central portion 19. The reduction in mechanical will be said to be substantial if the flexural rigidity in the anchor portions 18 is at least 20% less than the flexural rigidity in the central portion 19 of the deformable element 20.

A third layer 26 formed over second layer 24 is also illustrated in FIG. 2. This layer may have a variety of functions depending on the specific application of the doubly-anchored thermal actuator. When used in a liquid drop emitter or microvalve, third layer 26 may be a passivation layer having appropriate chemical resistance and electrical insulative properties. For use in a microswitch, third layer 26 may be a multi-layer lamination having a sub-layer that is insulative and a sub-layer that is conductive. Since third layer 26 is provided on the opposite side of second layer 24 from first layer 22, it is important that its flexural rigidity not impede the thermal bending of the deformable element. Third layer 26 is typically provided in a thickness that is substantially less than first layer 22 or second layer 24, and, if feasible, using materials that have very low Young's modulus.

Deformable element 20 is illustrated as being composed of three layers in FIG. 2. Practical implementations of the present inventions may include additional layers that are introduced for reasons of fabrication or for additional protection and passivation. Also, it is comprehended that any of the layers illustrated may be composed of multiple sub-layers for reasons of improved performance or fabrication advantages. All embodiments of the present inventions share the feature of having first and second layers 22, 24 that have significantly different coefficients of thermal expansion, thereby providing thermo-mechanical deformation when heated. Other layers, for example overlayer 26, may be added to provide additional beneficial functions, including improved reliability.

For some preferred embodiments of the present inventions lesser anchor portion rigidity is accomplished by forming the anchor portions of the second layer using a material having a significantly smaller Young's modulus than a material forming the central portion of the second layer. For example, anchor portions 24*a* of second layer 24 may be formed of aluminum and central portion 24*c* formed of titanium aluminide. Other approaches to achieving less rigidity in anchor portions as compared to the central portion of the deformable element include thinner layers or narrower effective widths in the anchor portions of the deformable element.

The geometry of the doubly-anchored thermal actuator 15 illustrated in FIG. 2, and in the other figures herein, is not to scale for typical microbeam structures. Typically, first layer 22 and second layer 24, are formed a few microns in thickness and the length of the doubly-anchored deformable element 20 is more than 100 microns, typically ~300 microns.

A more detailed understanding of the physics underlying the behavior of a deformable element may be approached by analysis of the partial differential equations that govern a beam supported at two anchor points. The co-ordinates and geometrical parameters to be followed herein are illustrated in FIG. 2. Deformable element 20 is a beam anchored to substrate 10 at opposing anchor edges 14. The axis along the deformable element is designated "x" wherein x=0 at the left side anchor edge 14, x=L at the center of the deformable element and x=2L at the right side anchor edge 14. In addition the boundary between the anchor portions 18 and central portion 19 of deformable element is located a distance $L_a$ from either anchor edge. The boundary between anchor and central portions should be understood to be approximate in that a practically constructed deformable element according to the present inventions will have a finite transition region over which the rigidity will change from an effective value in a central portion to an effective portion in an anchor portion. The deflection of the beam perpendicular to the x-axis is designated f(x). The deformation of the symmetric beam illustrated will be symmetric about the center, therefore the maximum deflection off-axis, $f_{max}$, will be located at x=L, i.e. $f_{max}=f(L)$.

The illustrated deformable element 20 is comprised of first layer 22 having a thickness of $h_1$ and second layer 24 having a thickness of $h_2$. The length of the microbeam between opposing anchor edges 14 is 2L. A practically implemented beam will also have a finite width, w. The side view illustrations of FIG. 2 do not show the width dimension. The width dimension is not important to the understanding of the present inventions for configurations wherein the width is uniform across the deformable element. However, for some preferred embodiments of the present inventions, the width of the deformable element, or of some layers of the deformable element, may be narrowed in the anchor portions to reduce the flexural rigidity.

The x-axis in FIG. 2 is shown spanning the space between the opposing anchor edge locations 14. The x-axis resides in what will be termed herein the central plane of the deformable element 20. This plane marks the position of a deformable element that is flat, having no residual deformation or buckle.

The standard equation for small oscillations of a vibrating beam is $$\rho hw\frac{\partial^2 u}{\partial t^2}+\frac{Eh^3w}{12(1-\sigma^2)}\frac{\partial^4 u}{\partial x^4}=0, \tag{1}$$

with which various standard boundary conditions are used. Here, x is the spatial coordinate along the length of the beam, t is time, u(x,t) is the displacement of the beam, ρ is the density of the beam, h is the thickness, w is the width, E is the Young's modulus, and σ is the Poisson ratio. The flexural rigidity, D, of the beam is captured in the second term of Equation 1 by the material properties, E and σ, the geometrical parameters, h and w, and the shape factor, 1/12. The flexural rigidity as follows:

$$D=\frac{Eh^3w}{12(1-\sigma^2)}. \tag{2}$$

For a multilayer beam the physical constants are all effective parameters, computed as weighted averages of the physical constants of the various layers, j:

$$h=\sum_{j=1}^{N}h_j, \tag{3}$$

$$E_j=\frac{1}{w}\sum_{j=1}^{M}w_{ji}E_{ji}, \tag{4}$$

$$E=\frac{1}{h}\sum_{j=1}^{N}E_jh_j \tag{5}$$

$$\rho=\frac{1}{h}\sum_{j=1}^{N}\rho_jh_j, \tag{6}$$

$$\alpha=\sum_{j=1}^{N}\frac{\alpha_jh_jE_j}{1-\sigma_j}\Big/\sum_{j=1}^{N}\frac{h_jE_j}{1-\sigma_j}, \tag{7}$$

$$1-\sigma^2=\frac{Eh^3}{12}\frac{1}{\sum_{j=1}^{N}\frac{1}{3}[(y_j-y_c)^3-(y_{j-1}-y_c)^3]\frac{E_j}{1-\sigma_j^2}}, \tag{8}$$

where $$y_0=0,\ y_j=\sum_{k=1}^{j}h_k,\ \text{and}\ y_c=\frac{\sum_{j=1}^{N}\frac{1}{2}\frac{E_j(y_j^2-y_{j-1}^2)}{1-\sigma_j^2}}{\sum_{j=1}^{N}\frac{E_jh_j}{1-\sigma_j^2}}. \tag{9}$$

$\alpha_j$ is the coefficient of thermal expansion of the $j^{th}$ layer and α is the effective coefficient of thermal expansion for the multilayer beam.

For some preferred embodiments of the present inventions the width of one or more layers j may be effectively narrowed in the anchor portion 18 relative to the central portion 19 of deformable element 20. Therefore an effective Young's modulus, $E_j$, is calculated for each layer in above Equation 4, by summing over the Young's modulus, $E_{ji}$, of each width portion of the jth layer, $w_{ji}$, and normalizing by the total width of the deformable element, w. For example, if a layer is narrowed by one-half, the effective Young's modulus of that layer, $E_j$, will be reduced to one-half of the bulk material Young's modulus value. Accounting for different effective layer widths in this fashion allows the analysis below to proceed using a model for the deformable element having a uniform width. If the overall width, $w_a$, of the anchor portion 18 is reduced with respect to the central portion width, $w_c$, that may be accounted for in the analysis by using the respective overall width, $w_a$ or $w_c$, for w when evaluating the flexural rigidity, D, in Equation 2 and the effective layer Young's modulus values $E_j$ in Equation 4.

Standard Equation 1 is amended to account for several additional physical effects including the compression or expansion of the beam due to heating, residual strains and boundary conditions that account for the moments applied to the beam ends by the attachment connections.

The primary effect of heating the constrained microbeam is a compressive stress. The heated microbeam, were it not constrained, would expand. In constraining the beam against expansion, the attachment connections compress the microbeam between the opposing anchor edges 14. For an undeformed shape of the microbeam, this thermally induced stress may be represented by adding a term to Equation 1 of the form:

$$Ehw\alpha T\frac{\partial^2 u}{\partial x^2} \tag{10}$$

In Equation 10 above, α is the mean coefficient of thermal expansion given in Equation 7, and T is the temperature. Such a term would represent a uniformly compressed beam.

However, the microbeam is not compressed uniformly. It is deformed, bowed outward, and the deformation will mitigate the compression. The local expansion of the microbeam is:

$$\sqrt{1+\left(\frac{\partial u}{\partial x}\right)^2}-1\cong\frac{1}{2}\left(\frac{\partial u}{\partial x}\right)^2. \tag{11}$$

The right hand term in Equation 11 is the first term in a Taylor expansion of the full expression on the left side of the equation. The right hand side term will be used herein as an approximation of the local expansion, justified by the very small magnitude of the deformations that are involved. Using the Taylor approximation in Equation 10, the net thermally induced local strain is:

$$\alpha T-\frac{1}{2}\left(\frac{\partial u}{\partial x}\right)^2. \tag{12}$$

The vertical component of the resulting stress is then:

$$Ehw\left(\alpha T-\frac{1}{2}\left(\frac{\partial u}{\partial x}\right)^2\right)\frac{\partial u}{\partial x}. \tag{13}$$

Therefore, the full mathematical model for small oscillations of the beam is:

$$\rho hw\frac{\partial^2 u}{\partial t^2}+\frac{Ewh^3}{12(1-\sigma^2)}\frac{\partial^4 u}{\partial x^4}+Ehw\frac{\partial}{\partial x}\left\{\left[\alpha T-\frac{1}{2}\left(\frac{\partial u}{\partial x}\right)^2\right]\frac{\partial u}{\partial x}\right\}=0. \tag{14}$$

For the purposes of the present invention, the beam will take on various shapes as it is made to cycle through a time-dependent temperature cycle, T(t), designed to cause buckling motion as illustrated in FIGS. 2(*a*) and 2(*b*) by the rest and deformed equilibrium positions. To further the analysis, let u(x,t)=f(x) at a thermal equilibrium. That is, f(x) is the equilibrium, non-time-varying shape of the beam at a given temperature, T.

Equation 14 is recast in terms of equilibrium shape f(x) at a fixed temperature T, yielding the following differential equation:

$$\frac{Ewh^3}{12(1-\sigma^2)}\frac{\partial^4 f}{\partial x^4}+Ewh\frac{\partial}{\partial x}\left\{\left[\alpha T-\frac{1}{2}\left(\frac{\partial f}{\partial x}\right)^2\right]\frac{\partial f}{\partial x}\right\}=0. \tag{15}$$

Carrying out the differential in the second term of Equation 15 results in the following:

$$\frac{Ewh^3}{12(1-\sigma^2)}\frac{\partial^4 f}{\partial x^4}+Ewh\left[\alpha T-\frac{3}{2}\left(\frac{\partial f}{\partial x}\right)^2\right]\frac{\partial^2 f}{\partial x^2}=0. \tag{16}$$

To further the analysis it is helpful to introduce the physical effects of heating the deformable element, producing a thermal moment, cT, and the load, P, for example, imposed by back pressure of a working fluid in a drop ejector, by impinging the valve seat of a microvalve or by closing microswitch. A simplifying assumption that applies to the present inventions is that both the heating and the load are predominately applied to the central portion 19 of the deformable element, the portion between the anchor portions 18 that extend from anchor edges 14 to $L_a$ along the x-axis in FIG. 2.

The present inventions require that an internal thermo-mechanical force be generated which acts against the pre-biased direction of the expansion buckling that occurs as the temperature of the deformed element increases. The required force is accomplished by designing an inhomogeneous structure, typically a planar laminate, comprised of materials having different thermo-mechanical properties, and especially substantially different coefficients of thermal expansion. For the bi-layer element illustrated in FIG. 2, a significant thermal moment, cT, will occur at an elevated temperature, T, if the coefficients of thermal expansion of the first layer 22 and the second layer 24 are substantially different while their respective values of Young's modulus are similar.

The thermal moment acts to bend the structure into an equilibrium shape in which the layer with the larger coefficient of thermal expansion is on the outside of the bend. Therefore, if second layer 24 has a coefficient of thermal expansion significantly larger than that of first layer 22, the thermal moment will act to bend the deformable element 20 upward in FIG. 2.

The thermal moment coefficient, c, of a two-dimensional laminate structure may be found from the materials properties and thickness values of the layers that comprise the laminate:

$$c=\frac{\sum_j \frac{1}{2}(y_j^2-y_{j-1}^2)(\alpha-\alpha_j)\frac{E_j}{1-\sigma_j^2}}{\sum_j \frac{1}{3}[(y_j-y_c)^3-(y_{j-1}-y_c)^3]\frac{E_j}{1-\sigma_j^2}}, \tag{17}$$

where $y_c$ is given in above Equation 9.

As long as the deformable element properties, heating, and working load are symmetric about x=L, an analysis of a "half beam", i.e. of differential equation over the interval x=0 to L, will capture the behavior of the whole deformable element 20. The present inventions may be understood by making this simplifying assumption of symmetry in properties and forces about the center of the deformable element. Herein below, Equation 16 is applied to the deformable element 20 illustrated in FIG. 2 wherein the deformable element properties and forces may have different values for the anchor portion 18 over the spatial range x=0 to $L_a$ as compared to the values for the central portion 19 over the spatial range x=$L_a$ to L. This is the "left-hand" side of symmetrical deformable element 20. The right-hand side will exhibit symmetrical results to the left-hand side analysis.

Applying the above equations to the left-hand side of deformable element 20 in FIG. 2 the following equilibrium differential equations and set of associated boundary conditions describe the deflection or shape, f(x), of the deformable element for a particular equilibrium temperature T above ambient.

$$\frac{E_i w_i h_i^3}{12(1-\sigma_i^2)}\frac{\partial^4 f}{\partial x^4}+E_i w_i h_i\left[\alpha_i T_i-\frac{3}{2}\left(\frac{\partial f}{\partial x}\right)^2\right]\frac{\partial^2 f}{\partial x^2}=P_i,\quad i=1,c \tag{18}$$

wherein the label "a" refers to anchor portion 18 extending from x=0 to x=$L_a$, and the label "c" refers to central portion 19 extending from x=$L_a$ to L. The load $P_i$ is assumed to be applied only in central portion 19: $P_a$=0, $P_c$=P(x), x=$L_a$ to L.

The applicable boundary conditions are:

$$f|_{x=0}=0;\quad \frac{\partial f}{\partial x}\Big|_{x=0}=0;\quad \frac{\partial f}{\partial x}\Big|_{x=L}=0;\quad \frac{\partial^3 f}{\partial x^3}\Big|_{x=L}=0; \tag{19}$$

and, at the transition x=$L_a$;

$$f^-|_{x=L_a}=f^+|_{x=L_a};\quad \frac{\partial f^-}{\partial x}\Big|_{x=L_a}=\frac{\partial f^+}{\partial x}\Big|_{x=L_a}; \tag{20}$$

$$D_a\frac{\partial^2 f^-}{\partial x^2}\Big|_{x=L_a}=D_c\frac{\partial^2 f^+}{\partial x^2}\Big|_{x=L_a}+D_c c_c T_c; \tag{21}$$

$$D_a\frac{\partial^3 f^-}{\partial x^3}\Big|_{x=L_a}-E_a h_a w_a\frac{1}{2}\left(\frac{\partial f^-}{\partial x}\right)^2\frac{\partial f^-}{\partial x}\Big|_{x=L_a}= D_c\frac{\partial^3 f^+}{\partial x^3}\Big|_{x=L_a}+E_c h_c w_c\left[\alpha_c T_c-\frac{1}{2}\left(\frac{\partial f^+}{\partial x}\right)^2\right]\frac{\partial f^+}{\partial x}\Big|_{x=L_a}-F^+(L_a); \tag{22}$$

-continued where $$D_a = \frac{E_a w_a h_a^3}{12(1-\sigma_a^2)};\quad D_c = \frac{E_c w_c h_c^3}{12(1-\sigma_c^2)};\quad \text{and}\quad F(x) = \int P(x)dx. \tag{23}$$

$D_a$ and $D_c$ are the flexural rigidity factors for the anchor portion 18 and central portion 19 of deformable element 20.

The above non-linear differential equation with boundary conditions at x=0, L, and $L_a$ is more easily solved mathematically using the following transformation of the variable x:

$$f(x) \to u_1(z),\quad z = \frac{L}{L_a}x,\quad 0 \le x \le L_a; \tag{24}$$

$$f(x) \to u_2(z),\quad z = L\left(\frac{x-L}{L_a-L}\right)x,\quad L_a \le x \le L.$$

These transformations collapse all boundary conditions to the left end (z=0), and all the conditions at the transition from anchor to central portions to the right end (z=L) of the new interval [0, L]. The resulting boundary value problem is:

$$\left(\frac{L}{L_a}\right)^4 D_a \frac{\partial^4 u_1}{\partial z^4} - E_a w_a h_a \frac{3}{2}\left(\frac{L}{L_a}\right)^4 \left(\frac{\partial u_1}{\partial z}\right)^2 \frac{\partial^2 u_1}{\partial z^2} = 0, \tag{25}$$

and $$\left(\frac{L}{L_a-L}\right)^4 D_c \frac{\partial^4 u_2}{\partial z^4} + E_c w_c h_c \left(\frac{L}{L_a-L}\right)^2 \left[\alpha_c T - \frac{3}{2}\left(\frac{L}{L_a-L}\right)^2 \left(\frac{\partial u_2}{\partial z}\right)^2\right] \frac{\partial^2 u_2}{\partial z^2} = P(z). \tag{26}$$

The accompanying boundary conditions are transformed as follows:

$$u_1|_{z=0} = 0;\quad \frac{\partial u_1}{\partial z}\bigg|_{z=0} = 0;\quad \frac{\partial u_2}{\partial z}\bigg|_{z=0} = 0;\quad \frac{\partial^3 u_2}{\partial z^3}\bigg|_{z=0} = 0. \tag{27}$$

$$u_1|_{z=L} = u_2|_{z=L};\quad \frac{L}{L_a}\frac{\partial u_1}{\partial z}\bigg|_{z=L} = \frac{L}{L_a-L}\frac{\partial u_2}{\partial z}\bigg|_{z=L}; \tag{28}$$

$$D_a\left(\frac{L}{L_a}\right)^2 \frac{\partial^2 u_1}{\partial z^2}\bigg|_{z=L} = D_c\left(\frac{L}{L_a-L}\right)^2 \frac{\partial^2 u_2}{\partial z^2}\bigg|_{z=L} + D_c c_c T; \tag{29}$$

$$D_a\left(\frac{L}{L_a}\right)^3 \frac{\partial^3 u_1}{\partial z^3}\bigg|_{z=L} - E_a h_a w_a \frac{1}{2}\left(\frac{L}{L_a}\right)^3 \left(\frac{\partial u_1}{\partial z}\right)^2 \frac{\partial u_1}{\partial z}\bigg|_{z=L} = -F(L) + D_c\left(\frac{L}{L_a-L}\right)^3 \frac{\partial^3 u_2}{\partial z^3}\bigg|_{z=L} + E_c h_c w_c \left(\frac{L}{L_a-L}\right)\left[\alpha_c T - \frac{1}{2}\left(\frac{L}{L_a-L}\right)^2 \left(\frac{\partial u_2}{\partial z}\right)^2\right] \frac{\partial u_2}{\partial z}\bigg|_{x=L}. \tag{30}$$

The above equations were solved numerically using calculation software for solving non-linear ordinary differential equations: COLSYS by Ascher, Christiansen and Russell. This calculation subroutine is available at Internet website: www.netlib.org.

An example design of preferred materials and layer thicknesses was modeled via numerical calculations. This example deformable element was composed of five layers. First layer 22 was composed of two sub-layers: sub-layer 22*a* formed of beta-silicon carbide (β-SiC), 0.3 μm thick; and sub-layer 22*b* formed of silicon oxide ($SiO_2$), 0.2 μm thick. Second layer 24 was composed of two materials, aluminum (Al) or titanium aluminide (TiAl), 1.5 μm thick, configured within layer 24 in portions 24*a* and 24*c* to provide different properties for the anchor portions 18 and central portion 19. Third layer 26 was composed of two sub-layers: sub-layer 26*a* formed of silicon oxide (SiO2), 0.5 μm thick; and sub-layer 26*b* formed of Teflon®(PTFE), 0.3 μm thick.

The modeled deformable element was 3.8 μm thick in total. The overall length, 2L was 300 μm and all layers had the same width, 30 μm. Values of the effective Young's modulus, density and thermal expansion coefficient may be calculated using above Equations 3 thru 9. The materials values and calculated effective parameters used in the model calculations are given in Table 1.

TABLE 1

| Layer | Material | h, thickness (μm) | E, Young's modulus (GPa) | α, TCE ($10^{-6}$) | ρ, density ($Kg/m^3$) | σ, Poisson's ratio |
|---|---|---|---|---|---|---|
| 26b | PTFE | 0.3 | 0.1 | 80 | 2200 | 0.25 |
| 26a | $SiO_2$ | 0.2 | 74 | 0.5 | 2200 | 0.25 |
| 24a | Al | 1.5 | 69 | 23.1 | 2700 | 0.25 |
| 24a | TiAl | 1.5 | 187 | 15.2 | 3320 | 0.25 |
| 24c | TiAl | 1.5 | 187 | 15.2 | 3320 | 0.25 |
| 22b | $SiO_2$ | 0.5 | 74 | 0.5 | 2200 | 0.25 |
| 22a | β-SiC | 1.3 | 448 | 1.52 | 3210 | 0.25 |
| Effective Values (Case 1) | (Al for 24a) | 3.8 | 114 | 0.0 | 2740 | 0.25 |
| Effective Values (Case 2) | (TiAl for 24a) | 3.8 | 194 | 5.65 | 2990 | 0.25 |
| Effective Values (Cases 1, 2) | (with TiAl for 24c) | 3.8 | 194 | 5.65 | 2990 | 0.25 |

Two configurations of the anchor portion 24*a* of second layer 24 were modeled and calculated: Case 1 having aluminum for anchor portion 24*a* and Case 2 having titanium aluminide for anchor portion 24*a*. Both modeled configurations had the same materials arrangement for the central portion 19 of deformable element 20, titanium aluminide for central portion 24*c* of second layer 24. The coefficient of thermal moment for the central portion 19 of deformable element 20, was calculated from Equation 17 to be c=0.0533 $cm^{-1}$° $C.^{-1}$ using the parameters in Table 1.

Figure 3:
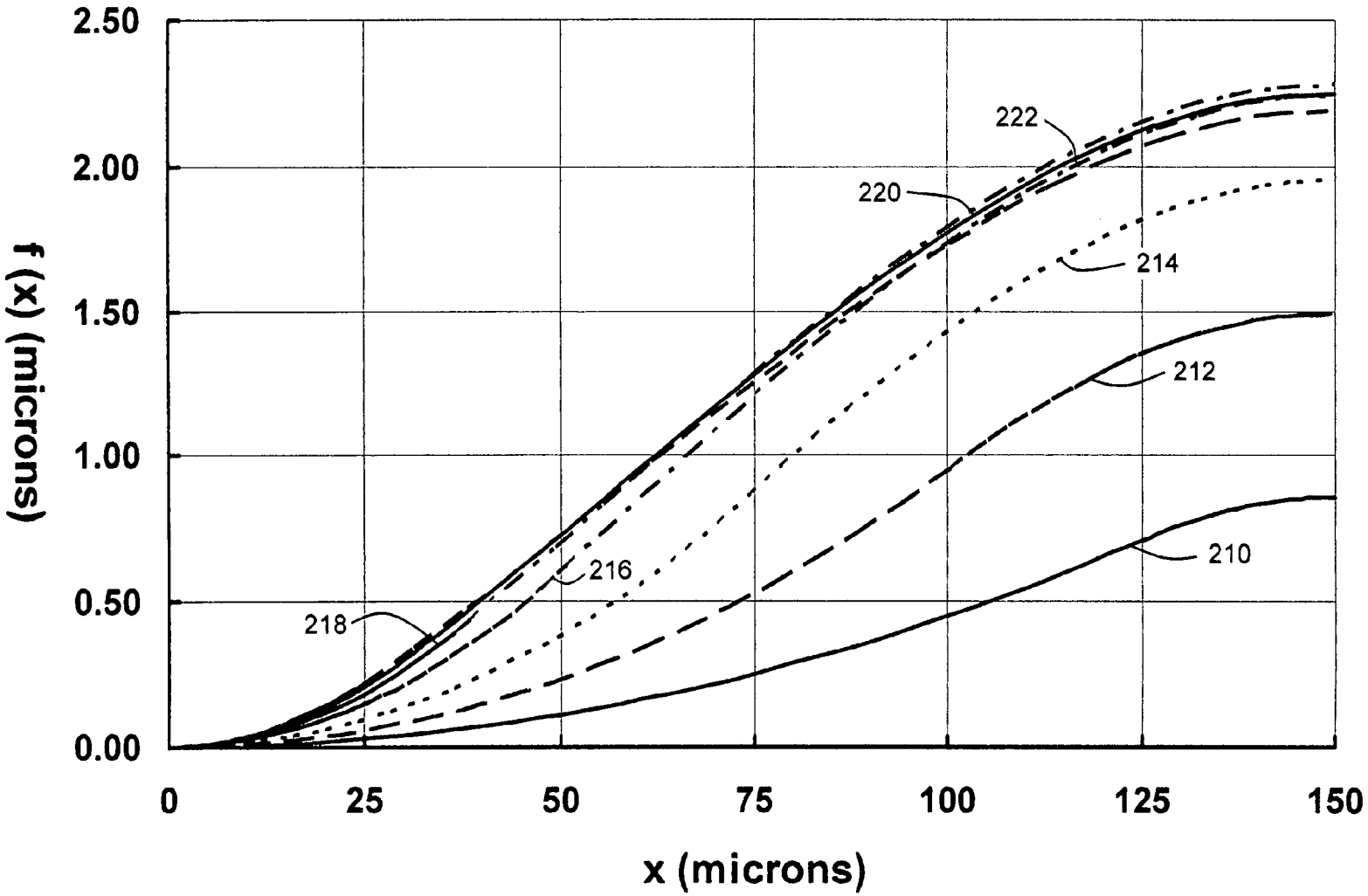
FIG. 3 is a theoretical calculation of the equilibrium displacement of a deformable element having different amounts of heating along its length.

The results of the numerical solution of Equations 25–30 for the model configuration, Case 2, having titanium aluminum throughout second layer 24, are plotted in FIG. 3. The plots show the calculated equilibrium shape f(x) of the left-hand side of deformable element 20 after the central portion 19 has been heated to reach a temperature T of 100° C. above an ambient temperature. The amount of deformation f(x) is expressed in units of microns, as is the position along the deformable element, x. Deformed element 20 is assumed to have a symmetric shape so that the right-hand side would have the complementary shape. The maximum deformation, $f_{max}$ occurs at the beam center, x=150 μm.

Individual curves 210 through 222 plot different positions of the anchor-portion-to-central-portion transition, i.e., different values for $L_a$. The values of $L_a$ associated with each curve are as follows: curve 210 ($L_a$=⅚L); curve 212

($L_a$=4/6L); curve 214 ($L_a$=3/6L); curve 216 ($L_a$=2/6L); curve 218 ($L_a$=1/4L); curve 220 ($L_a$=1/5L); and curve 222 ($L_a$=1/6L).

For this Case 2 configuration the anchor portions 18 and the central portion 19 of deformable element 20 have the same mechanical properties. Consequently the differing amount of maximum deformation is arising from the assumption that only the central portion is heated and that only the central portion experiences the load, P. These assumptions approximate a case wherein the heater is patterned to be effective only in the central portion and the load is configured to apply most resistance at the center of the deformable element 20. This latter condition is conveyed for a liquid drop generator by the hour glass shape of the liquid chamber illustrated in FIGS. 7 and 8 herein below. Because the chamber is most constricted surrounding the central portion 19 of the deformable element 20, the dominant back pressure load of the fluid will be applied to the central portion 19. It may be understood by studying the plots of FIG. 3 that for Case 2 there is an optimum choice for $L_a$ that maximizes the maximum deformation, i.e., $f_{max}$≈2.27 μm for $L_a$=1/4L.

Figure 4:
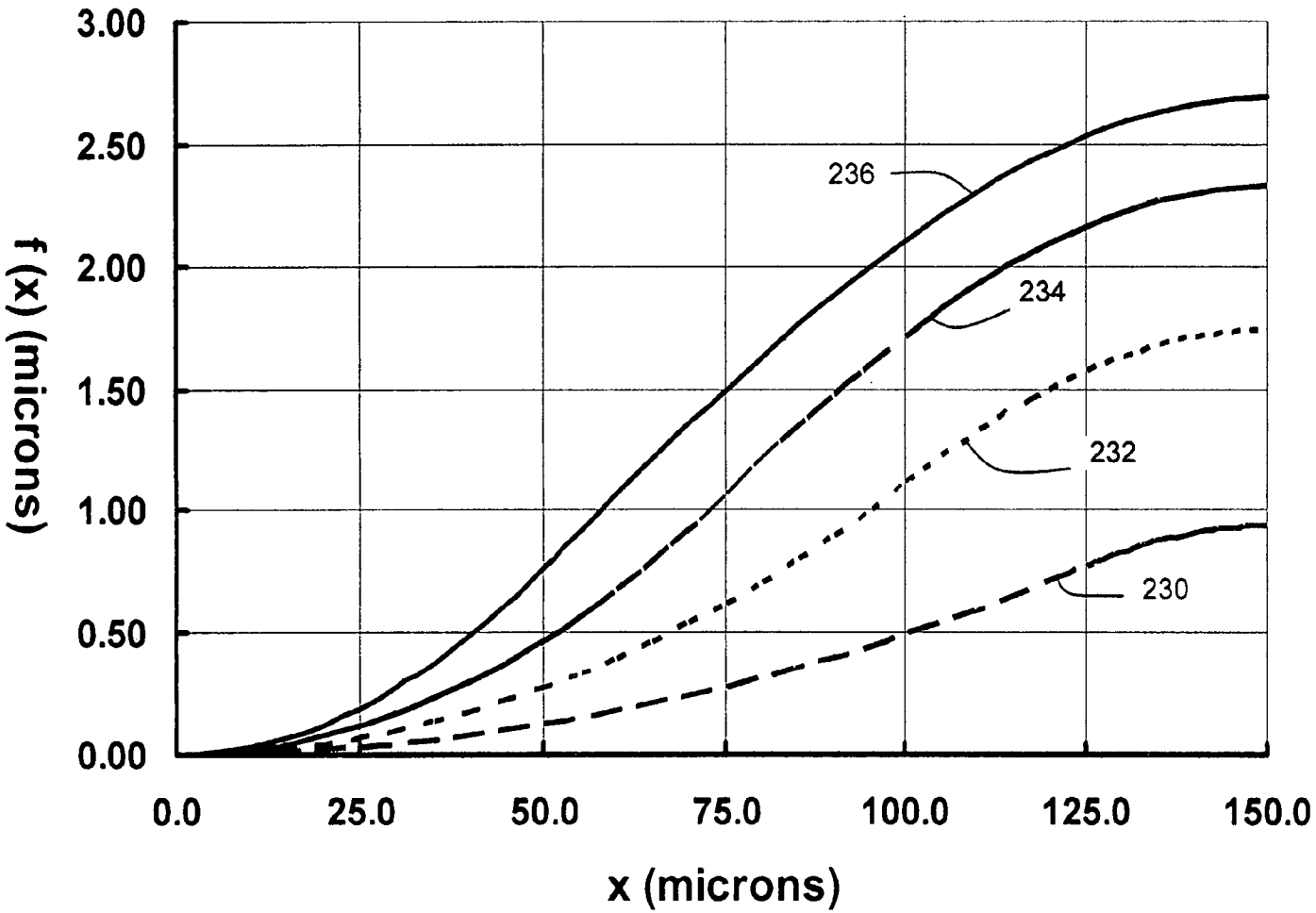
FIG. 4 is a theoretical calculation of the equilibrium displacement of a deformable element having different amounts of heating along its length and having anchor portions that are less mechanically rigid than central portions.

The results of the numerical solution of Equations 25–30 for the model configuration, Case 1, having aluminum for the anchor portion 24*a* and titanium aluminide for central portion 24*c* of second layer 24, are plotted in FIG. 4. The plots show the calculated equilibrium shape f(x) of the left-hand side of deformable element 20 after the central portion 19 has been heated to reach a temperature T of 100° C. above an ambient temperature. The amount of deformation f(x) is expressed in units of microns, as is the position along the deformable element, x. Deformed element 20 is assumed to have a symmetric shape so that the right-hand side would have the complementary shape. The maximum deformation, $f_{max}$ occurs at the beam center, x=150 μm.

Individual curves 230 through 236 plot different positions of the anchor-portion-to-central-portion transition, i.e., different values for $L_a$. The values of $L_a$ associated with each curve are as follows: curve 230 ($L_a$=5/6L); curve 232 ($L_a$=4/6L); curve 234 ($L_a$=3/6L); and curve 236 ($L_a$=2/6L).

For this Case 1 configuration the anchor portions 18 and the central portion 19 of deformable element 20 have the different mechanical properties. In particular the anchor portion is less rigid for Case I as compared to Case 2. This may be appreciated by comparing the effective Young's modulus values in Table 1. For Case 1 the effective Young's modulus is 114 GPa, approximately 40% less than the effective Young's modulus for Case 2, 194 GPa. The differing amounts of maximum deformation exhibited by curves 230–236 in FIG. 4 arise from the reduced flexural rigidity in the anchor portions 18 as well as from assumptions that only the central portion is heated and that only the central portion experiences the load, P.

The maximum deformation of the Case 1 deformable element is $f_{max}$≈2.69 μm for $L_a$=1/3L. Reducing the flexural rigidity in the anchor portion by 40% resulted in an increase in maximum deformation of 18%.

The results plotted in FIGS. 3 and 4 were based on a two-dimensional analysis. A three dimensional numerical analysis has also been carried out for deformable elements 20 of the Case 1 and Case 2 configurations. A numerical solver, CFD-ACE* by ESI CFD, Inc. was used for the 3-D analysis. This software package is available at Internet website www.esi-group.com.

Figure 5:
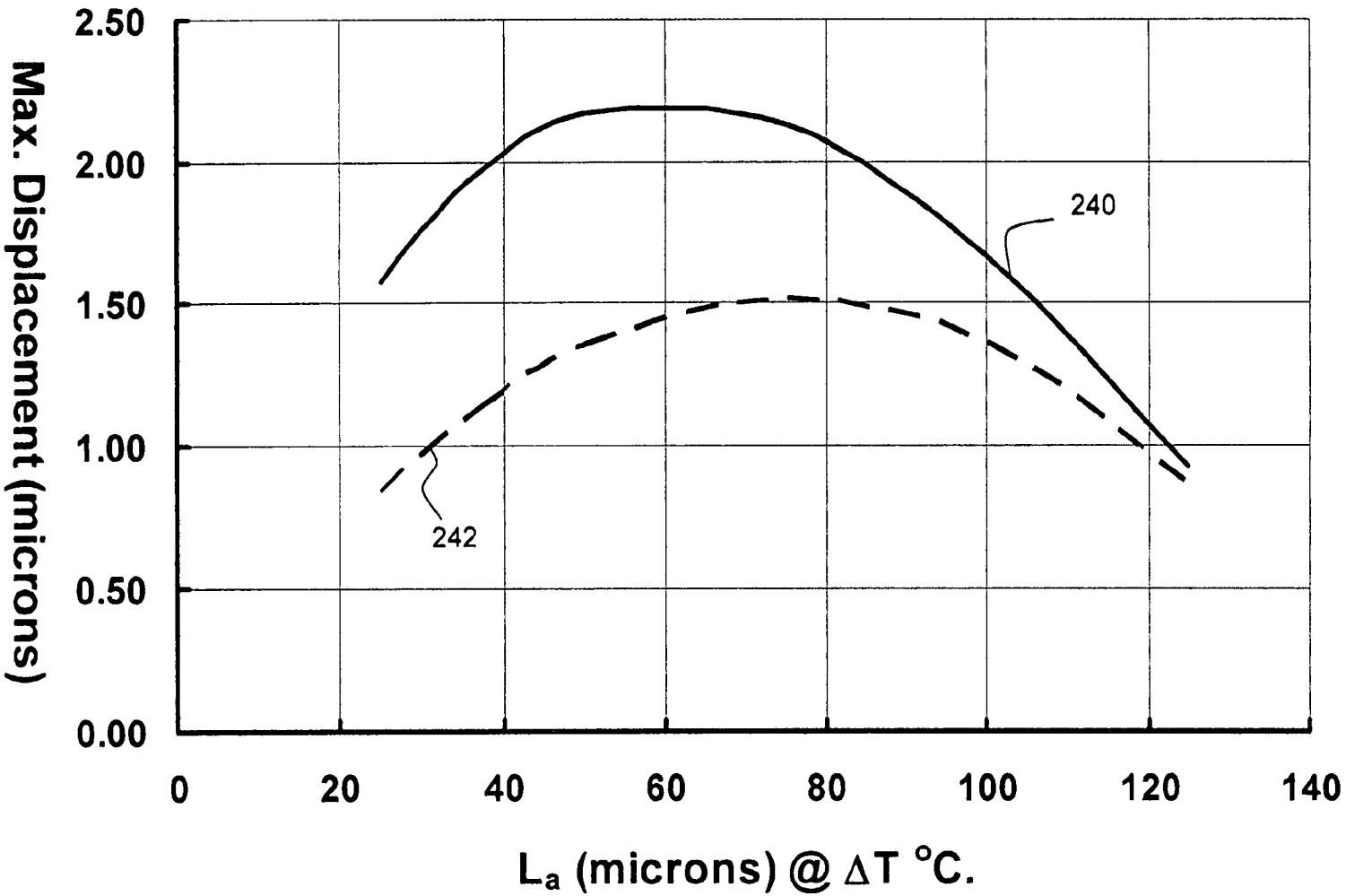
FIG. 5 is a theoretical comparison of the maximum equilibrium displacement of deformable elements having different amounts of heating along their lengths and having anchor portions that are equally or less mechanically rigid than central portions.

The 3-D calculations were performed to determine the value of f(L)=$f_{max}$ as a function of the position of the anchor portion to central portion transition, $L_a$. The results of these three-dimensional numerical solutions of Equations 25–30 for the model are plotted in FIG. 5. Plot 240 in FIG. 5 is for Case 1 wherein the anchor portions 24*a* of the second layer are formed of aluminum. Plot 242 in FIG. 5 is for Case 2 wherein the anchor portions 24*a* of the second layer are formed of titanium aluminide. The three-dimensional calculations show that a two-dimensional analysis overstates the amount of deformation. However, the three-dimensional calculations also show that the proportional benefit of reducing the rigidity in the anchor portions 18 is understated by the two-dimensional analysis. Plots 240 and 242 in FIG. 5 show that the ~40% reduction in anchor portion rigidity resulted in a ~45% increase in maximum deformation, i.e. $f_{max}$ increases from 1.51 μm to 2.2 μm.

The plots of FIG. 5 clearly demonstrate the increase in maximum deformation that is achievable by reducing the flexural rigidity of a portion the deformable element 20 of a doubly-anchored thermal actuator 15 adjacent the anchoring edges 14. Improvement in the amount of deformation for the same energy input may be utilized to increase the distance between actuator positions, to reduce the overall amount of energy used, or to increase the repetition frequency of activations.

The amount of improvement depends on the many materials, shape and geometrical factors discussed above. The means for reducing the flexural rigidity in the model deformable element 20 analyzed above was to replace part of the second layer 24 with a material having a substantially lower Young's modulus. It may be understood from examining Equations 2, 25–30 that any means of reducing the flexural rigidity parameter, D, will result in improved deformation for a given input of energy. The means to reduce flexural rigidity include reducing the effective thickness, h; reducing the effective width, w; reducing the effective Young's modulus, E; or any combination of these.

The application of doubly-anchored thermal actuators having reduced flexural rigidity near the anchor locations to several micro devices will now be discussed. The present inventions include the incorporation of such thermal actuators into liquid drop emitters, especially ink jet printheads, and into liquid microvalves and electrical microswitches.

Figure 6:
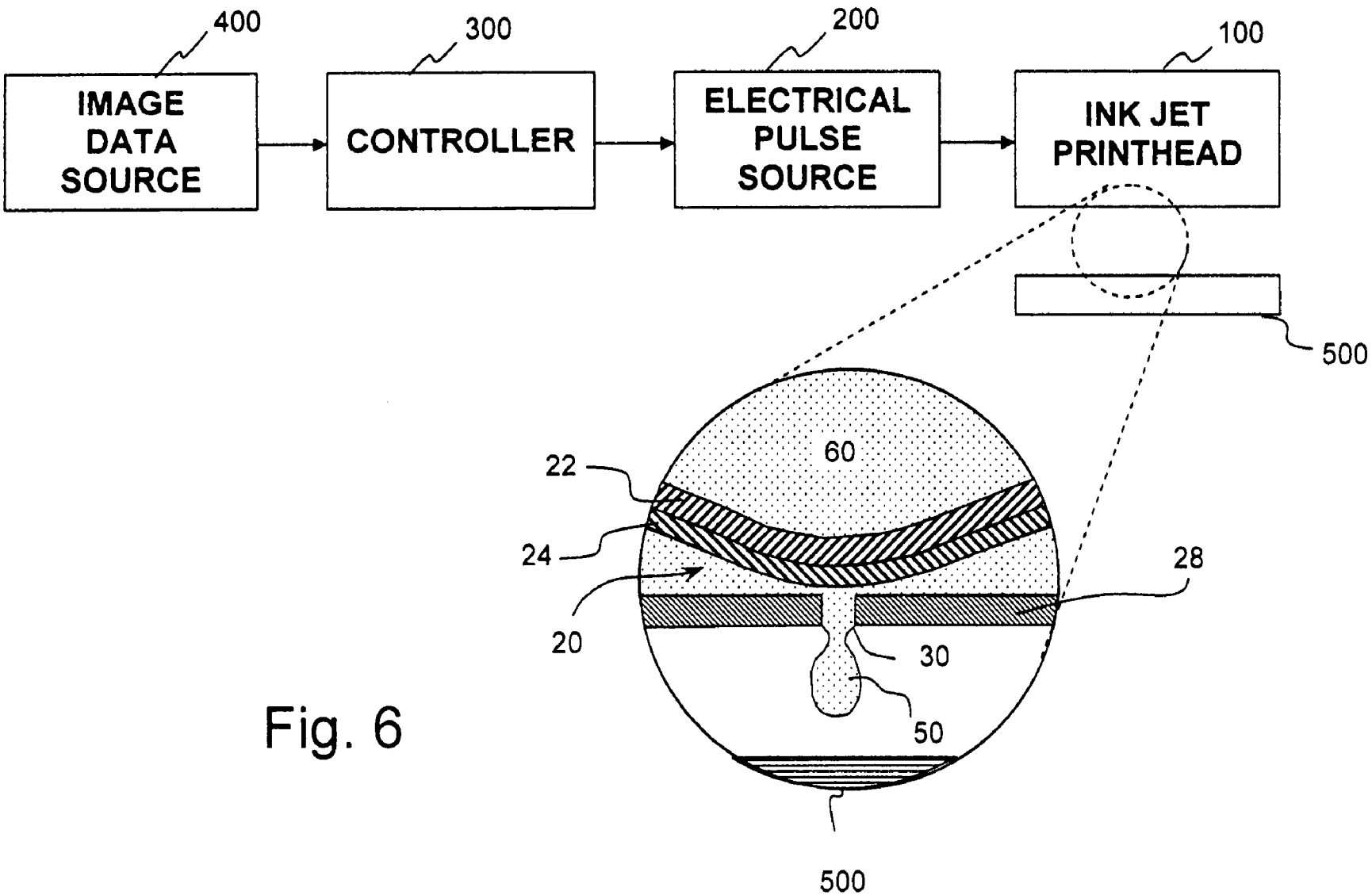
FIG. 6 is a schematic illustration of an ink jet system according to the present invention.

Turning now to FIG. 6, there is shown a schematic representation of an ink jet printing system that may use an apparatus according to the present inventions. The system includes an image data source 400, which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each doubly-anchored thermal actuator 15 within ink jet printhead 100. The electrical energy pulses cause a doubly-anchored thermal actuator 15 to rapidly deform, pressurizing ink 60 located at nozzle 30, and emitting an ink drop 50 which lands on receiver 500.

Figure 7:
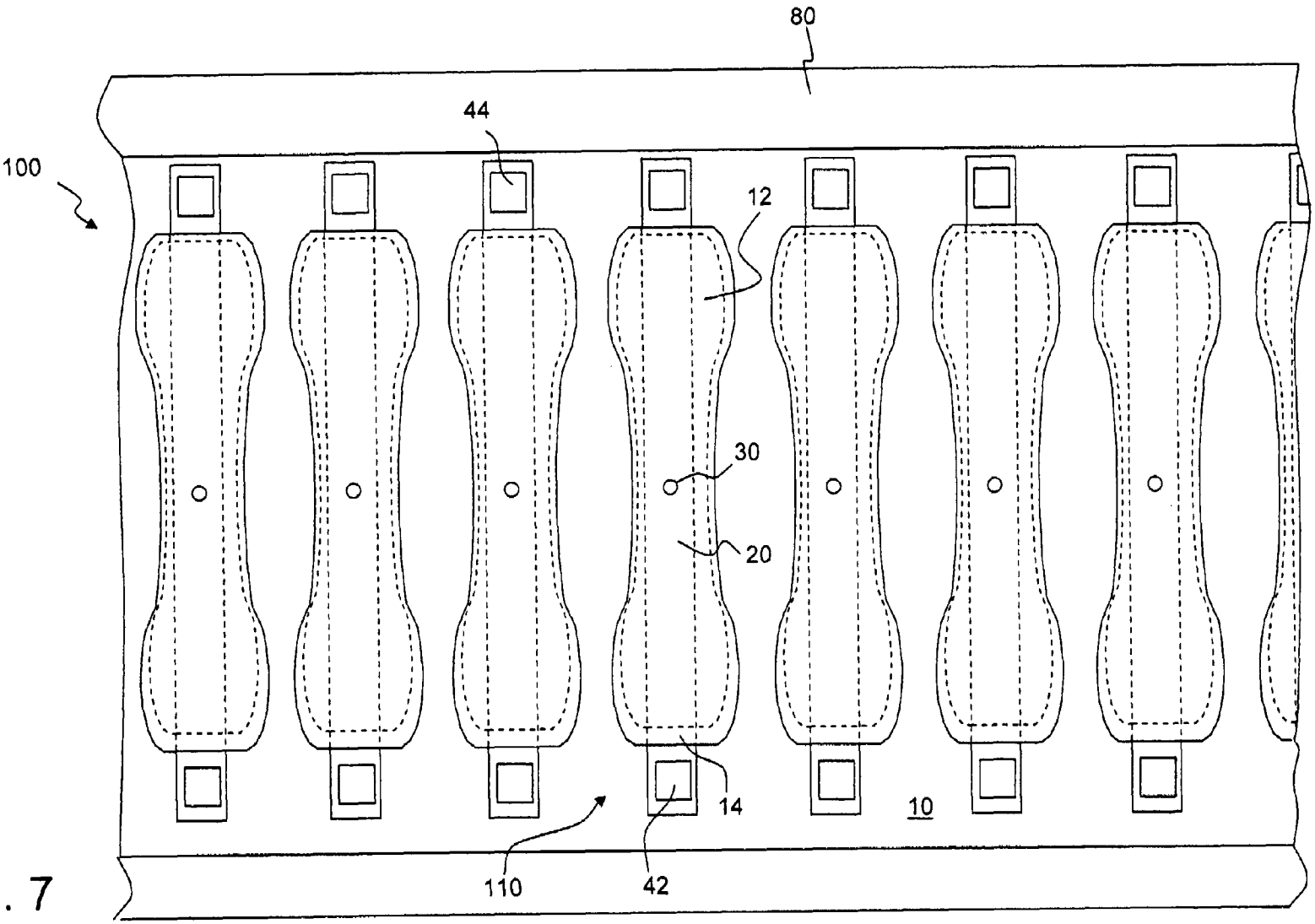
FIG. 7 is a plan view of an array of ink jet units or liquid drop emitter units according to the present invention.

FIG. 7 shows a plan view of a portion of ink jet printhead 100. An array of thermally actuated ink jet units 110 is shown having nozzles 30 centrally aligned, and ink chambers 12. The ink jet units 110 are formed on and in a substrate 10 using microelectronic fabrication methods.

Each drop emitter unit 110 has associated electrical heater electrode contacts 42, 44 which are formed with, or are electrically connected to, an electrically resistive heater which is formed in a second layer of the deformable element 20 of a doubly-anchored thermal actuator and participates in the thermo-mechanical effects as will be described. The electrical resistor in this embodiment is coincident with the second layer 24 of the deformable element 20 and is not visible separately in the plan views of FIG. 7. Element 80 of the printhead 100 is a mounting structure which provides a mounting surface for microelectronic substrate 10 and other means for interconnecting the liquid supply, electrical signals, and mechanical interface features.

Figure 8A:
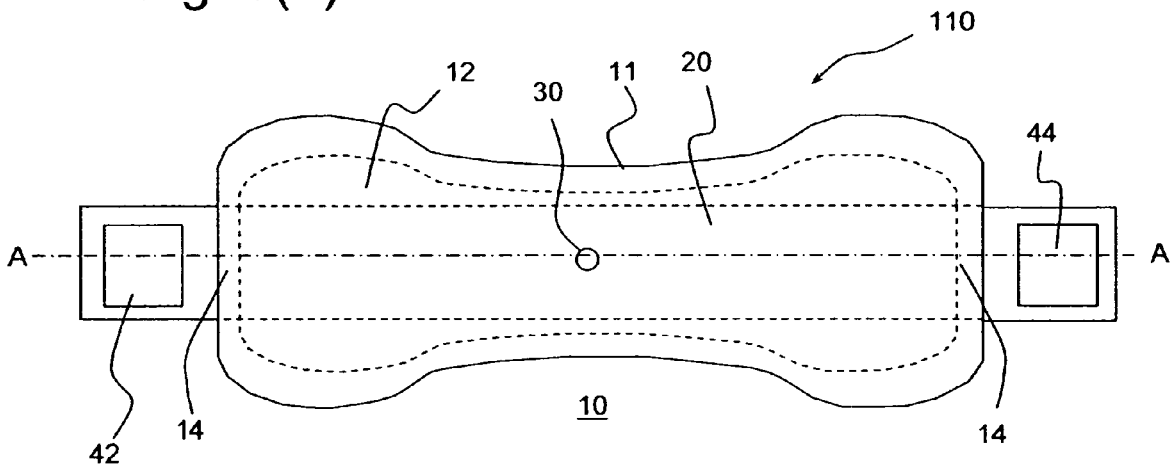
FIGS. 8(*a*) and 8(*b*) are enlarged plan views of an individual ink jet unit and a doubly-anchored thermal actuator as illustrated in FIG. 7.
Figure 8B:
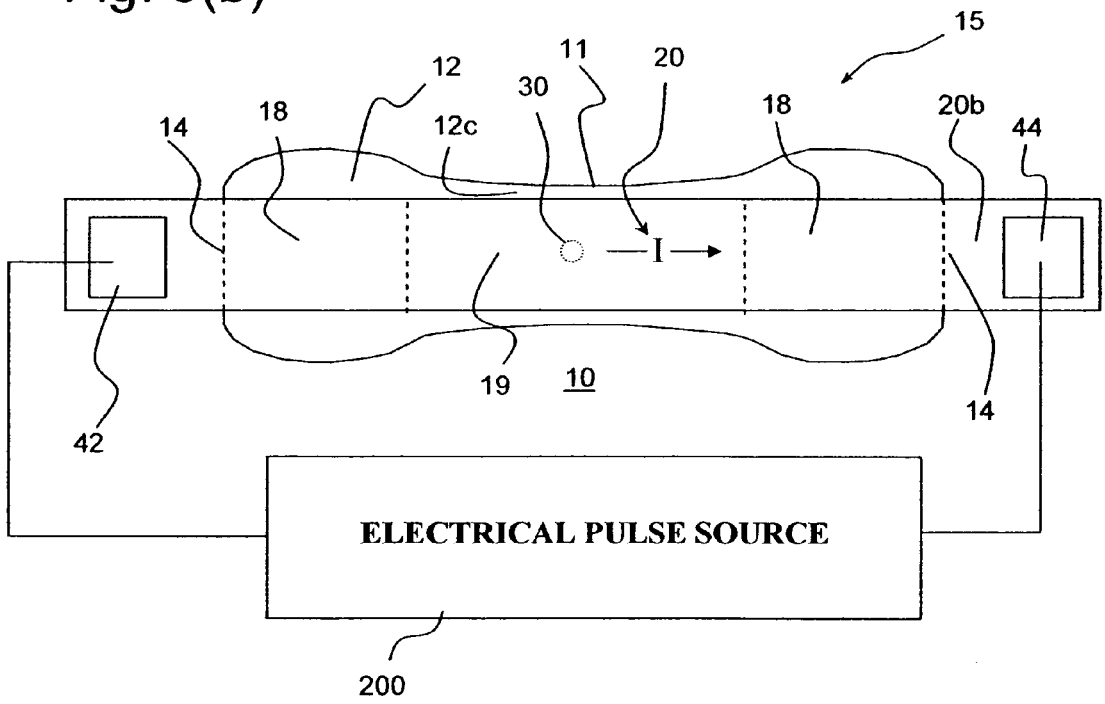

FIG. 8(*a*) illustrates a plan view of a single drop emitter unit 110 and a second plan view FIG. 8*b* with the liquid chamber cover 28, including nozzle 30, removed.

The doubly-anchored thermal actuator 15, shown in phantom in FIG. 8*a* can be seen with solid lines in FIG. 8(*b*). The deformable element 20 of doubly-anchored thermal actuator 15 extends from opposing anchor edges 14 of liquid chamber 12 that is formed as a depression in substrate 10. Deformable element fixed portion 20*b* is bonded to substrate 10 and anchors the deformable element 20.

The deformable element 20 of the actuator has the shape of a long, thin and wide beam. This shape is merely illustrative of deformable elements for doubly-anchored thermal actuators that can be used. Many other shapes are applicable. For some embodiments of the present invention the deformable element is a plate attached to the base element continuously around its perimeter.

In FIG. 8 the fluid chamber 12 has a narrowed wall portion at 12*c* that conforms to the central portion 19 of deformable element 20, spaced away to provide clearance for the actuator movement during doubly-anchored deformation. The close positioning of the walls of chamber 12, where the maximum deformation of the doubly-anchored actuator occurs, helps to concentrate the pressure impulse generated to efficiently affect liquid drop emission at the nozzle 30.

FIG. 8(*b*) illustrates schematically the attachment of electrical pulse source 200 to the electrically resistive heater (coincident with second layer 24 of deformable element 20) at heater electrodes 42 and 44. Voltage differences are applied to voltage terminals 42 and 44 to cause resistance heating via the resistor. This is generally indicated by an arrow showing a current I. In the plan views of FIG. 8, the central portion 19 of deformable element 20 moves toward the viewer when it is electrically pulsed and buckles outward from its central plane. Drops are emitted toward the viewer from the nozzle 30 in cover 28. This geometry of actuation and drop emission is called a "roof shooter" in many ink jet disclosures.

Figure 9A:
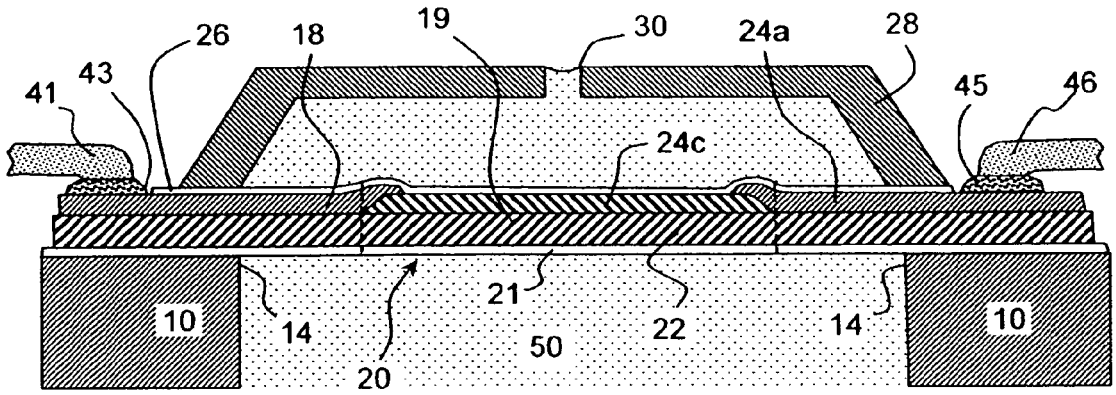
FIGS. 9(*a*) and 9(*b*) are side views illustrating the quiescent and drop ejection positions of a liquid drop emitter according to the present inventions.
Figure 9B:
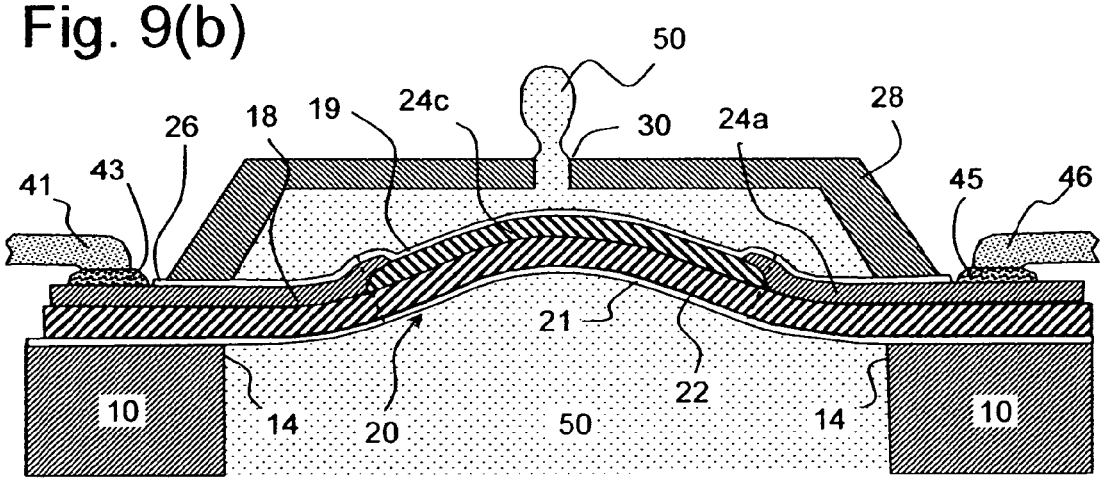

FIG. 9 illustrates in side view a doubly-anchored thermal actuator according to a preferred embodiment of the present invention. In FIG. 9(*a*) the deformable element 20 is in a first quiescent position. FIG. 9(*b*) shows the deformable element buckled upward to a second position. Deformable element 20 is anchored to substrate 10, which serves as a base element for the doubly-anchored thermal actuator When used as actuators in drop emitters the buckling response of the deformable element 20 must be rapid enough to sufficiently pressurize the liquid at the nozzle. Typically, electrically resistive heating apparatus is adapted to apply heat pulses. Electrical pulse durations of less than 10 μsecs. are used and, preferably, durations less than 2 μsecs.

FIGS. 10 through 16 illustrate fabrication processing steps for constructing a single liquid drop emitter according to some of the preferred embodiments of the present invention. For these embodiments the second layer 24 is constructed using an electrically resistive material, such as titanium aluminide, and a portion is patterned into a resistor for carrying electrical current, I. the anchor portion 24*a* of second layer 24 is replaced with a softer, conductive metal, for example aluminum, to both confine the heated area to a central portion and to significantly reduce the flexural rigidity of the anchor portions 18 of the deformable element 20.

Figure 10:
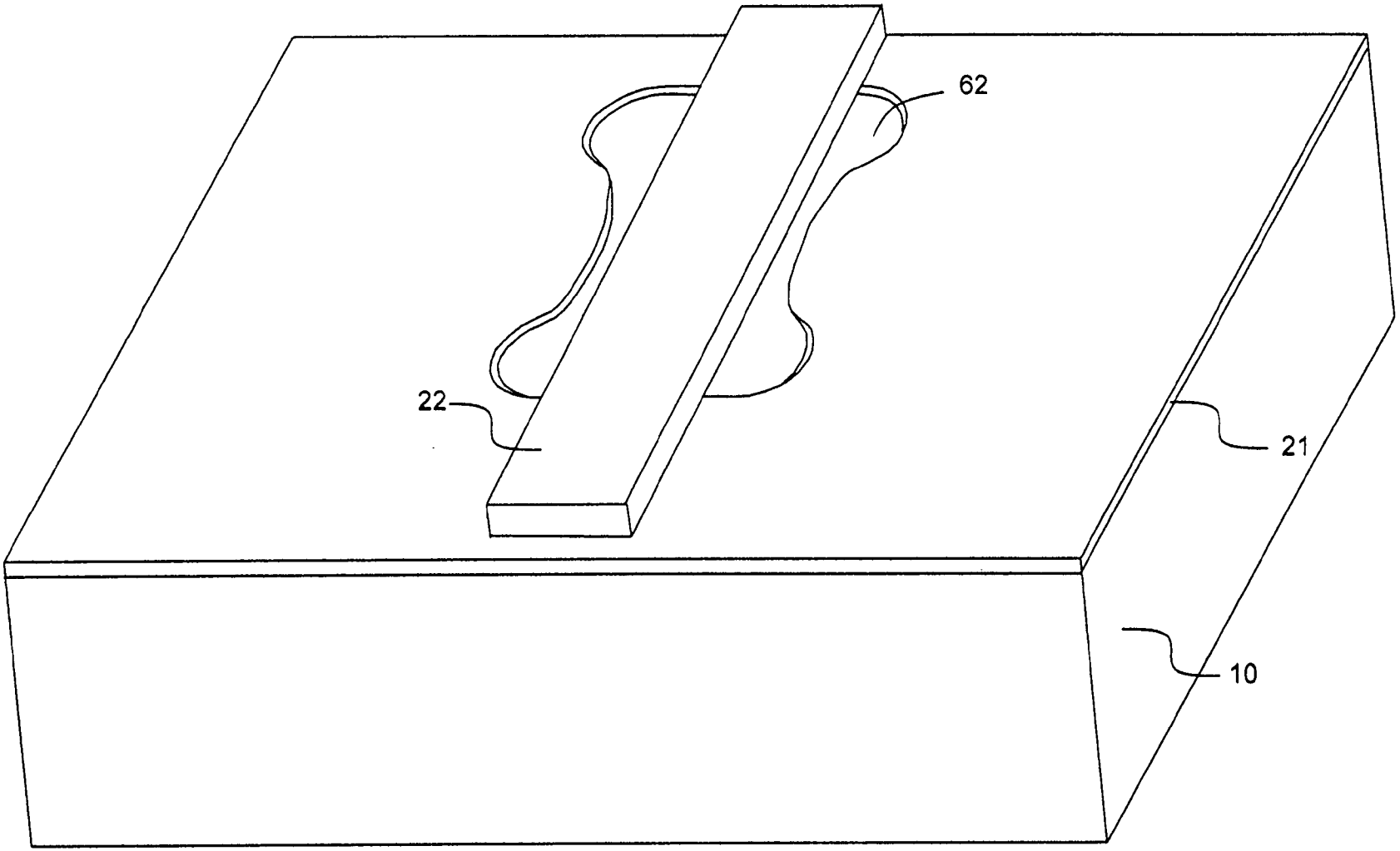
FIG. 10 is a perspective view of the first stages of a process suitable for constructing a doubly-anchored thermal actuator according to the present invention wherein a substrate is prepared and a first layer of the deformable element is deposited and patterned.

FIG. 10 illustrates a microelectronic material substrate 10, for example, single crystal silicon, in the initial stages of a microelectromechanical fabrication process sequence. In the illustrated fabrication sequence, substrate 10 becomes the base element 10 of a doubly-anchored thermal actuator. Passivation layer 21 may be a material such as an oxide, a nitride, polysilicon or the like and also functions as an etch stop for a rear side etch near the end of the fabrication sequence. Etchable regions 62 are opened in layer 21 to provide for liquid refill around the finished deformable element and to release the deformable element.

FIG. 10 also illustrates a first layer 22 of a future deformable element having been deposited and patterned over the previously prepared substrate. A first material used for first layer 22 has a low coefficient of thermal expansion and a relatively high Young's modulus. Typical materials suitable for first layer 22 are oxides or nitrides of silicon and beta silicon carbide. However, many microelectronic materials will serve the first layer 22 function of helping to generate a strong thermal moment and storing elastic energy when strained. First layer 22 may also be composed of sub-layers of more than one material. For many microactuator device applications, first layer 22 will be a few microns in thickness.

Figure 11:
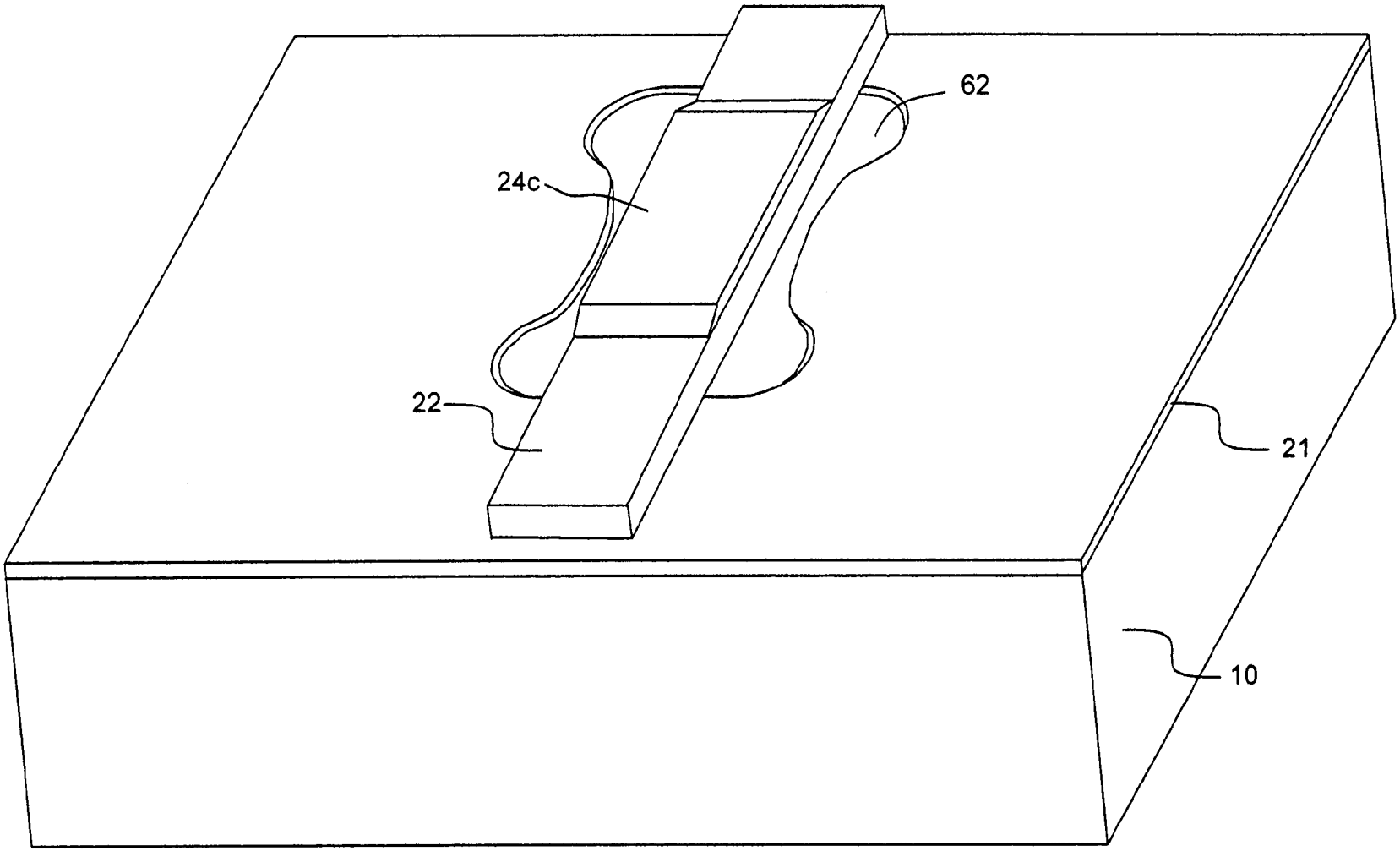
FIG. 11 is a perspective view of the next stages of the process illustrated in FIG. 10 wherein a central portion of a second layer of the deformable element is formed and patterned.

FIG. 11 illustrates the formation of second layer 24 of a future deformable element overlaying first layer 22. Second layer 24 is constructed of a second material having a large coefficient of thermal expansion, such as a metal. In order to generate a large thermal moment and to maximize the storage of elastic energy for doubly-anchored actuation, it is preferable that the second material has a Young's modulus that is comparable to that of the first material. A preferred second material for the present inventions is intermetallic titanium aluminide. Deposition of intermetallic titanium aluminide may be carried out, for example, by RF or pulsed-DC magnetron sputtering. For the embodiments of the present inventions illustrated in FIGS. 10–16, second layer 24 is also electrically resistive forming a resistor pattern that also defines the central portion 24*c* of second layer 24 and the central portion 19 of deformable element 20.

Figure 12:
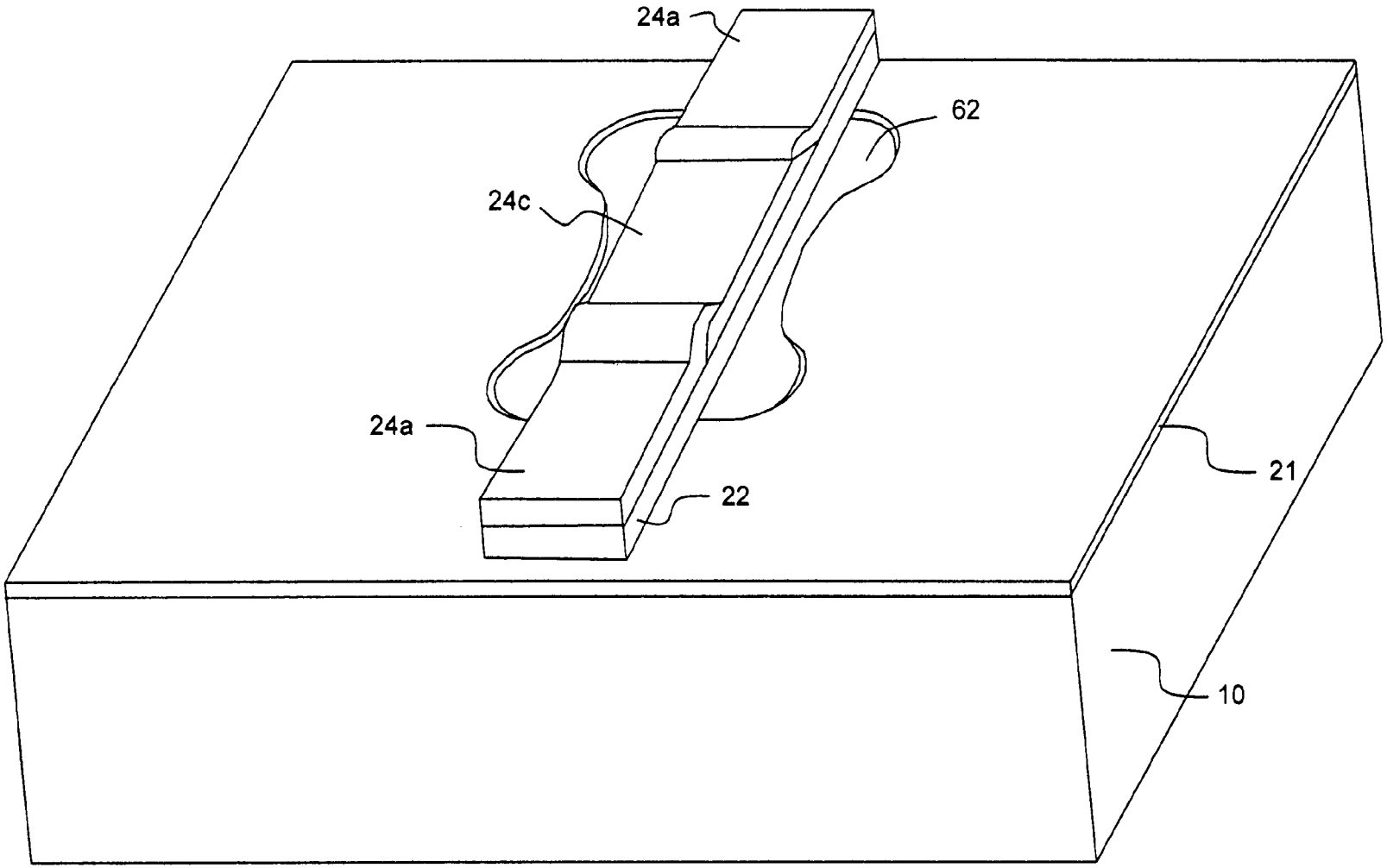
FIG. 12 is a perspective view of the next stages of the process illustrated in FIGS. 10–11 wherein an anchor portion of a second layer of the deformable element is formed.

FIG. 12 illustrates the completion of the formation of second layer 24 by the addition of a softer metallic material such as aluminum. This material forms the anchor portions 24*a* of second layer 24. The aluminum also forms an electrical connection to the electrically resistive material formed as the central portion 24*c* of the second layer.

Figure 13:
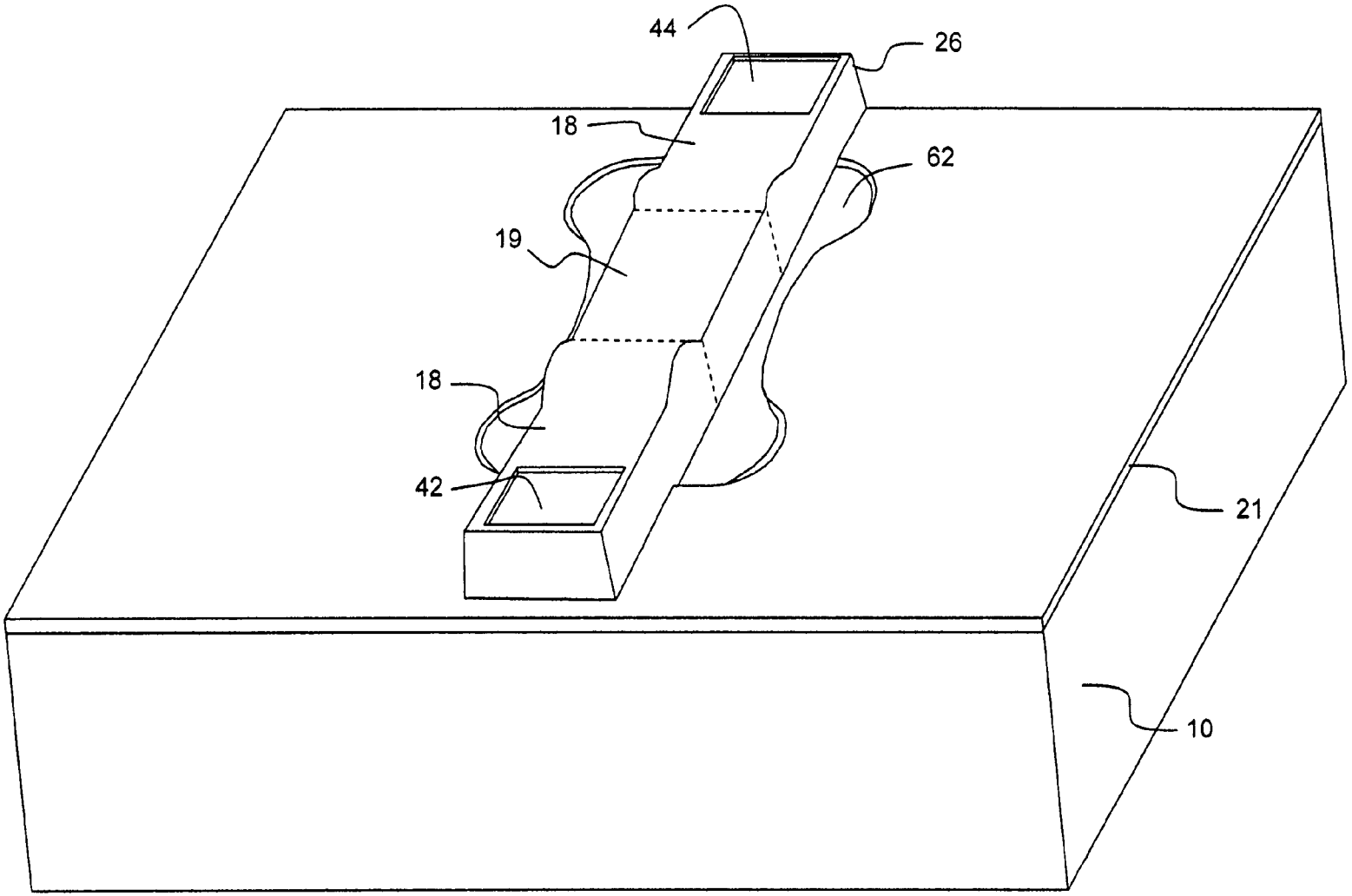
FIG. 13 is a perspective view of the next stages of the process illustrated in FIGS. 10–12 wherein a protective passivation layer is formed and patterned.

FIG. 13 illustrates the completion of the formation of third layer 26 over the previously formed layers of the deformable element. As was noted above, third layer 26 may be used for a variety of functions. For the ink jet printhead application being fabricated in FIGS. 10–16, third layer 26 provides protection of the deformable element from chemical and electrical interactions with the ink (working fluid). Third layer may be composed of sub-layers of different materials, for example both oxide and organic coatings.

Third layer 26 is windowed to provide electrical contact electrodes 42 and 44. Heater electrodes 42, 44 may make contact with circuitry previously formed in substrate 10 passing through vias in first layer 22 and passivation layer 21 (not shown in FIG. 13). Alternately, as illustrated herein, heater electrodes 42, 44 may be contacted externally by other standard electrical interconnection methods, such as tape automated bonding (TAB) or wire bonding.

Alternate embodiments of the present inventions utilize an additional electrical resistor element to apply heat pulses to the deformable element. In this case such an element may be constructed as one of more additional laminations positioned between first layer 22 and second layer 24 or above second layer 24. Application of the heating pulse directly to the thermally expanding layer, second layer 24, is beneficial in promoting the maximum thermal moment by maximizing the thermal expansion differential between second layer 24 and first layer 22. However, because additional laminations comprising the electrical resistor heater element will contribute to the overall thermo-mechanical behavior of the deformable element, the most favorable positioning of these laminations, above or below second layer 24, will depend on the mechanical properties of the additional layers.

Figure 14:
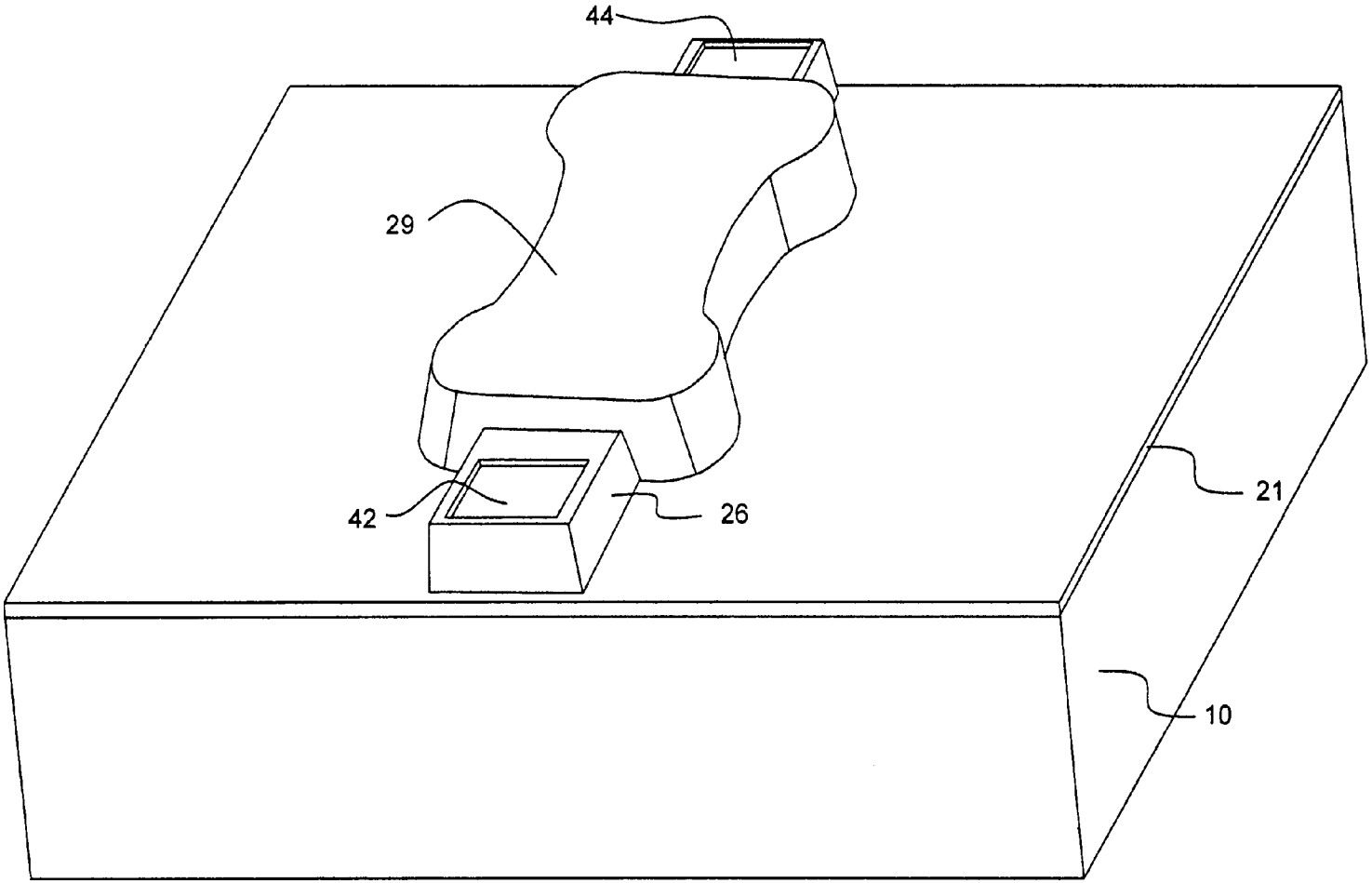
FIG. 14 is a perspective view of the next stages of the process illustrated in FIGS. 10–13 wherein a sacrificial layer in the shape of the liquid filling a chamber of a drop emitter according to the present invention is formed.

FIG. 14 shows the addition of a sacrificial layer 29, which is formed into the shape of the interior of a chamber of a liquid drop emitter. Sacrificial layer 29 is formed over the layers previously deposited. A suitable material for this purpose is polyimide. Polyimide is applied to the device substrate in sufficient depth to also planarize the surface that has the topography of first layer 22, second layer 24, third layer 26 and any additional layers that have been added for various purposes. Any material that can be selectively removed with respect to the adjacent materials may be used to construct sacrificial structure 29.

Figure 15:
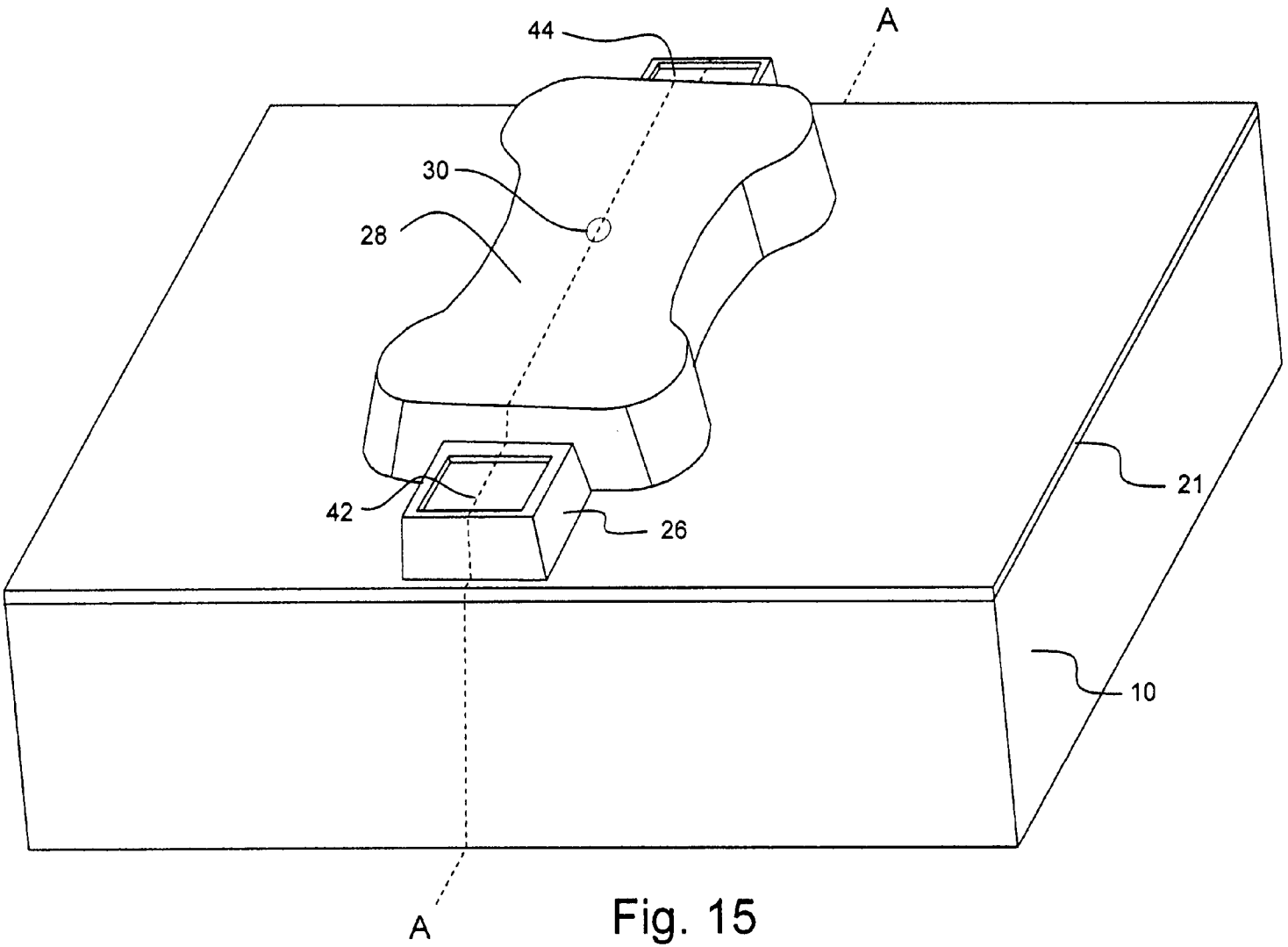
FIG. 15 is a perspective view of the next stages of the process illustrated in FIGS. 10–14 wherein a liquid chamber and nozzle of a drop emitter according to the present invention is formed.

FIG. 15 illustrates drop emitter liquid upper chamber walls and cover 28 formed by depositing a conformal material, such as plasma deposited silicon oxide, nitride, or the like, over the sacrificial layer structure 29. This layer is patterned to complete the drop emitter chamber, which will be additionally formed by etching portions of substrate 10 and indicated as chamber 12 in FIGS. 7 and 8. Nozzle 30 is formed in the drop emitter upper chamber 28, communicating to the sacrificial material layer 29, which remains within the drop emitter upper chamber walls 28 at this stage of the fabrication sequence.

Figure 16A:
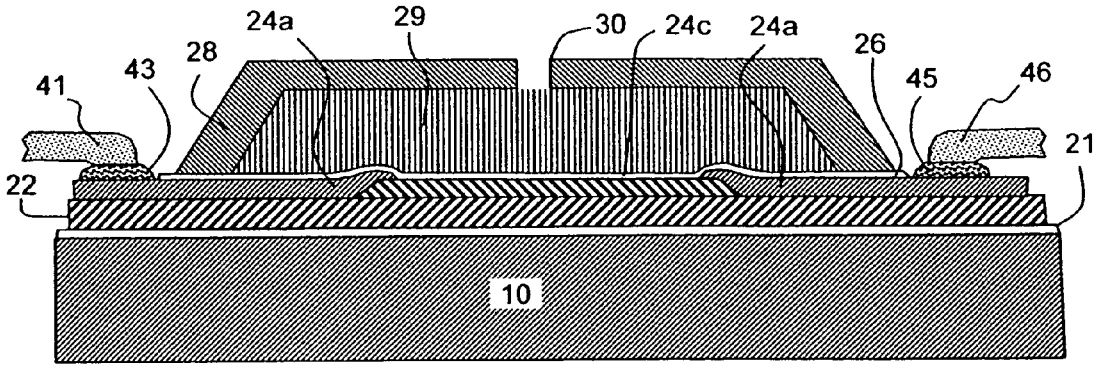
FIGS. 16(*a*)–16(*c*) are a side views of the final stages of the process illustrated in FIGS. 10–15 wherein a liquid supply pathway is formed and the sacrificial layer is removed to complete a liquid drop emitter according to the present invention.
Figure 16B:
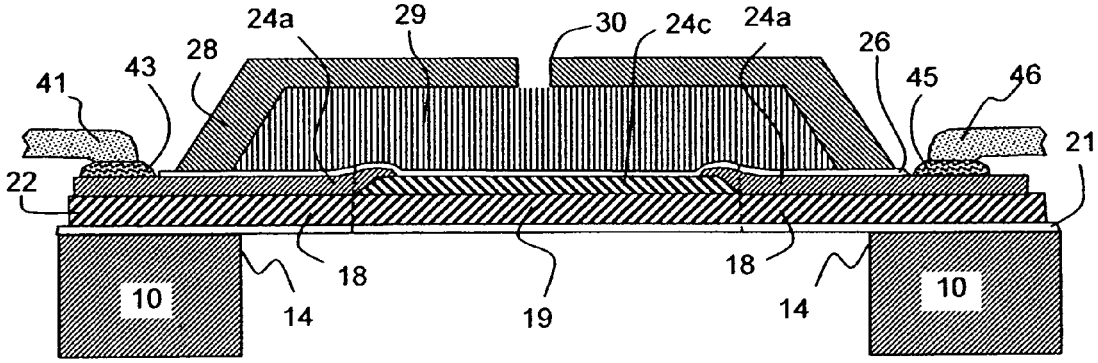
Figure 16C:
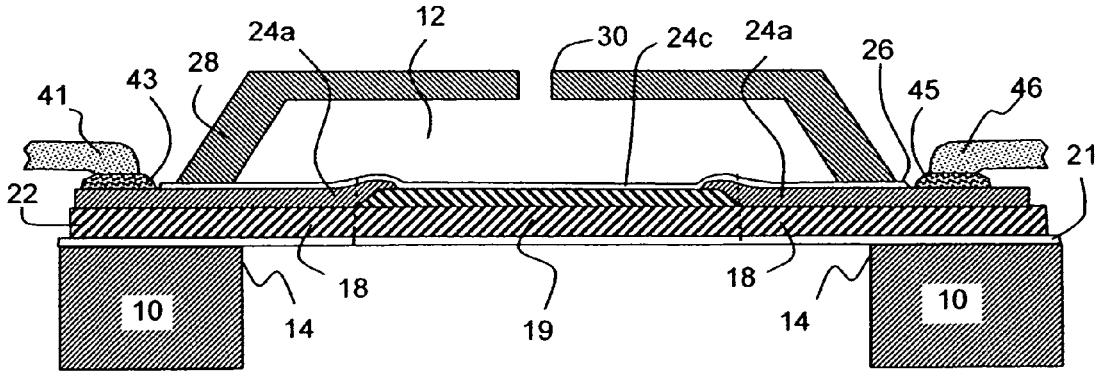

FIGS. 16(*a*) through 16(*c*) show side views of the device through a section indicated as A—A in FIG. 15. In FIG. 16(*a*) the sacrificial layer 29 is enclosed within the drop emitter upper chamber walls 28 except for nozzle opening 30. Also illustrated in FIG. 16(*a*), substrate 10 is intact. In FIG. 16(*b*), substrate 10 is removed beneath the deformable element 20 and the liquid chamber areas 12 (see FIGS. 10–13) around and beside the deformable element 20. The removal may be done by an anisotropic etching process such as reactive ion etching, orientation dependent etching for the case where the substrate used is single crystal silicon, or some combination of wet and dry etching methods. For constructing a doubly-anchored thermal actuator alone, the sacrificial structure and liquid chamber steps are not needed and this step of etching away substrate 10 may be used to release the deformable element.

In FIG. 16(*c*) the sacrificial material layer 29 has been removed by dry etching using oxygen and fluorine sources in the case of the use of a polyimide. The etchant gasses enter via the nozzle 30 and from the newly opened fluid supply chamber area 12, etched previously from the backside of substrate 10. This step releases the deformable element 20 and completes the fabrication of a liquid drop emitter structure.

FIGS. 10 through 16 illustrate a preferred fabrication sequence. However, many other construction approaches may be followed using well known microelectronic fabrication processes and materials. For the purposes of the present invention, any fabrication approach which results in a deformable element including a first layer 22, a second layer 24 and flexural rigidity in the anchor portions 18 substantially less than the flexural rigidity in the central portion 19 connection of the deformable element 20 may be followed. Further, in the illustrated sequence of FIGS. 10 through 16, the chamber walls 12, 28 and nozzle 30 of a liquid drop emitter were formed in situ on substrate 10. Alternatively a doubly-anchored thermal actuator could be constructed separately and bonded to a liquid chamber component to form a liquid drop emitter.

FIGS. 10 through 16 illustrate preferred embodiments in which the second layer is formed of an electrically resistive material. A portion of second layer 24 is formed into a coincident resistor portion carrying current when an electrical pulse is applied to a pair of heater electrodes 42, 44, thereby heating directly the second layer 24. In other preferred embodiments of the present inventions, the second layer 24 is heated by other apparatus adapted to apply heat to the deformable element. For example, a thin film resistor structure can be formed over first layer 22 and then second layer 24 formed upon it. Or, a thin film resistor structure can be formed on top of second layer 24.

Figure 20A:
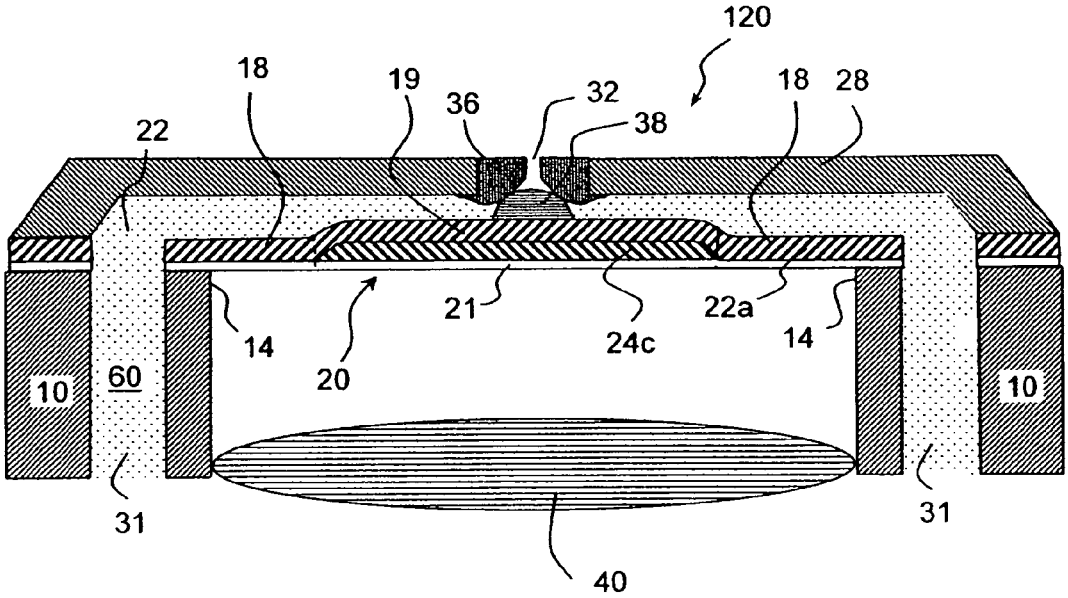
FIGS. 20(*a*) and 20(*b*) are side views illustrating the operation of a normally closed microvalve operated by light energy heating pulses according to preferred embodiments of the present invention.
Figure 20B:
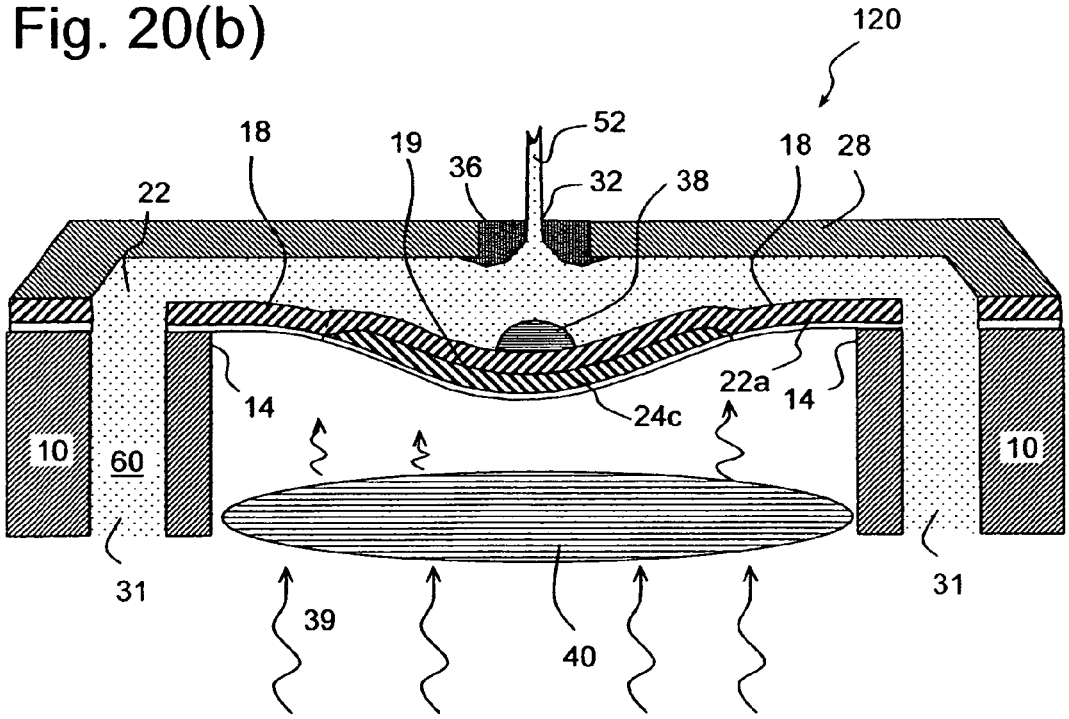

Heat may be introduced to the second layer 24 by apparatus other than by electrical resistors. Pulses of light energy could be absorbed by the first and second layers of the deformable element or by an additional layer added specifically to function as an efficient absorber of a particular spectrum of light energy. The use of light energy pulses to apply heating pulses is illustrated in FIG. 20 herein below in connection with doubly-anchored thermal actuator microvalves according to the present inventions. Any apparatus, which can be adapted to transfer pulses of heat energy to the deformable element, are anticipated as viable means for practicing the present invention.

Figure 17A:
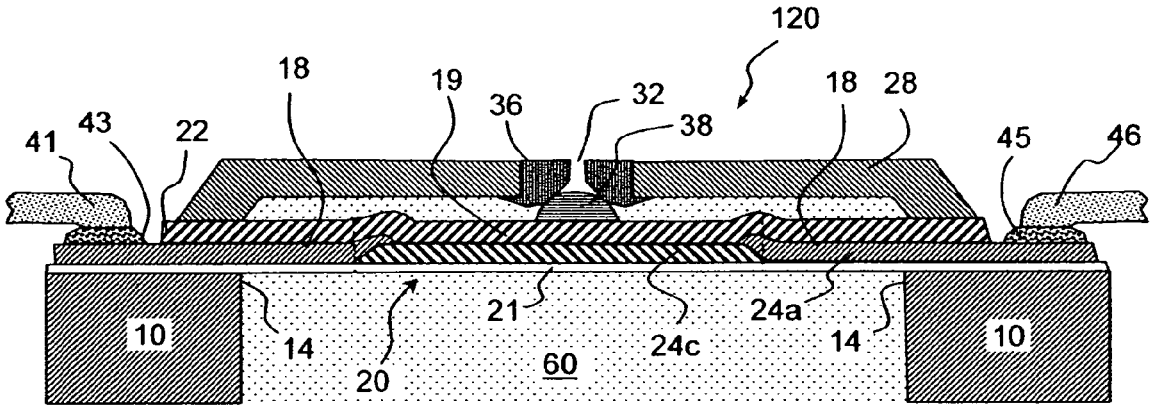
FIGS. 17(*a*) and 17(*b*) are side views illustrating the closed and open positions of a normally closed liquid microvalve according to the present inventions.
Figure 17B:
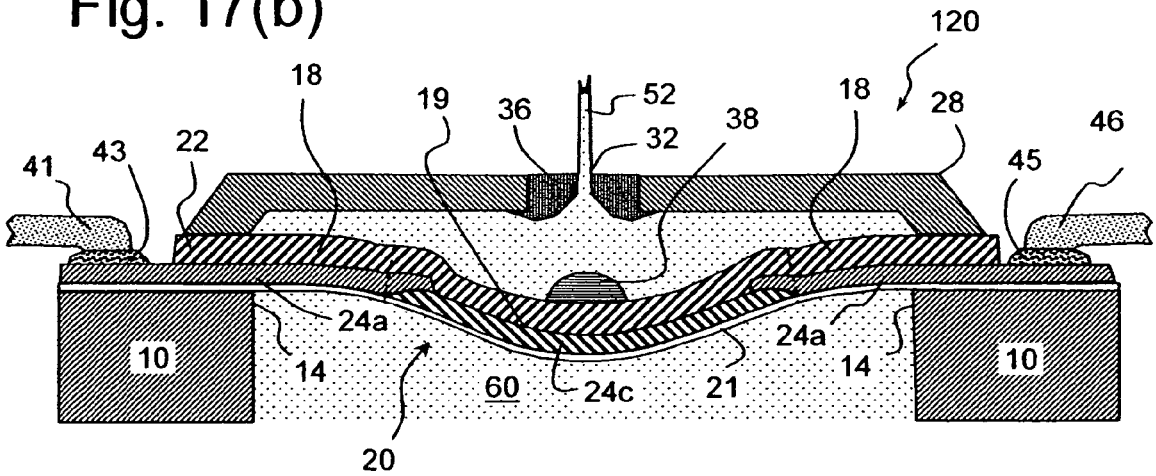
Figure 18A:
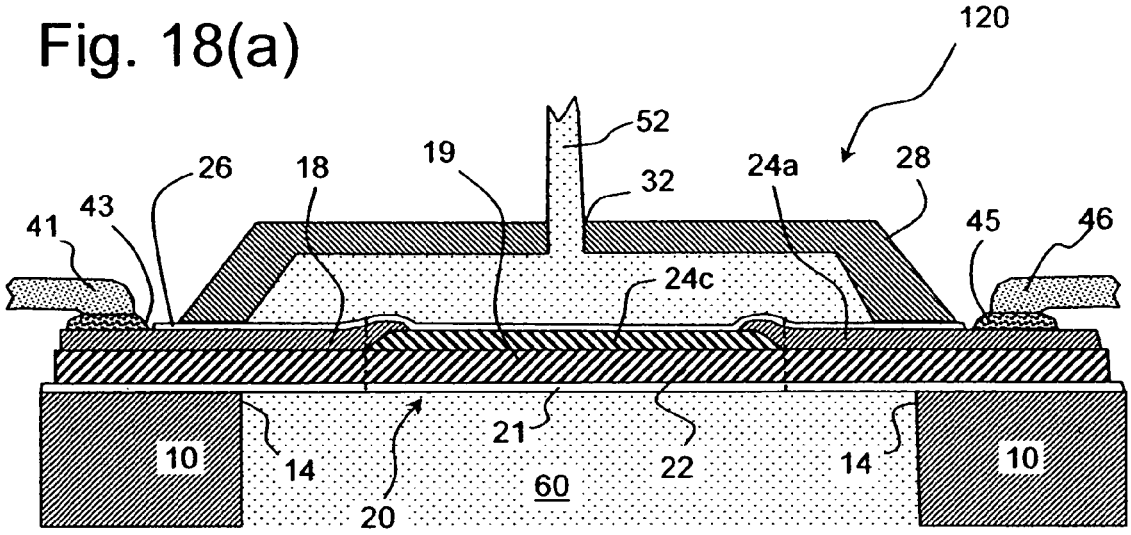
FIGS. 18(*a*) and 18(*b*) are side views illustrating the operation of a normally open microvalve according to preferred embodiments of the present invention.
Figure 18B:
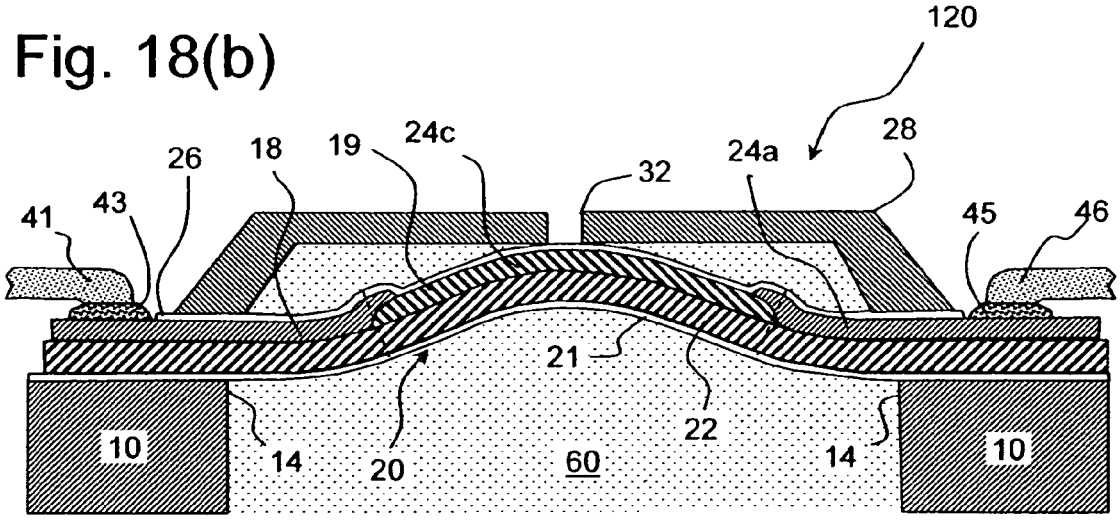

Doubly-anchored thermal actuators according to the present inventions are useful in the construction of fluid microvalves. A normally closed fluid microvalve configuration is illustrated in FIG. 17 and a normally open fluid microvalve is shown in FIG. 18. For both normally open and normally closed valve configurations, the doubly-anchored thermal actuator is advantageous because of the significantly improved energy efficiency or maximum deflection.

A normally closed microvalve may be configured as shown in FIG. 17(*a*) so that first layer 22 is urged against a fluid flow port 32 when the deformable element 20 is in its rest shape. In the illustrated valve configuration, a valve sealing member 38 is carried on first layer 22. Valve seat 38 seals against valve seat 36. Passivation layer 21 is omitted for this valve configuration since first layer 22 can perform the passivation function. In the configuration illustrated, fluid is admitted from a source under pressure via an inlet path (not shown) around the deformable element as illustrated for the ink jet drop generator chamber illustrated in above FIG. 8. When a heat pulse is applied to deformable element 20, the valve opens to a maximum extent, emitting stream 52 (FIG. 17(*b*)). The valve may be maintained in an open state by continuing to heat the deformable element sufficiently to maintain the upward buckled state.

A normally open microvalve may be configured as shown in FIG. 18(*a*). The deformable element 20 is positioned in proximity to a fluid flow port 32, sufficiently close so that the buckling deformation of deformable element 20 is sufficient to close flow port 32. While not illustrated in FIG. 18, a valve sealing member could be carried by deformable element 20 and a valve seat could be provided in a manner similar to the normally closed microvalve illustrated in FIG. 17. When a heat pulse is applied to deformable element 20 the valve closes by urging the deformable element against fluid flow port 32. The valve may be maintained in a closed state by continuing to heat the deformable element sufficiently to maintain the upward buckled state.

The previously discussed illustrations of doubly-anchored thermal actuators, liquid drop emitters and microvalves have shown deformable elements in the shape of thin rectangular microbeams attached at opposite ends to opposing anchor edges in a semi-rigid connection. The long edges of the deformable elements were not attached and were free to move resulting in a two-dimensional buckling deformation. Alternatively, a deformable element may be configured as a plate attached around a fully closed perimeter.

Figure 19A:
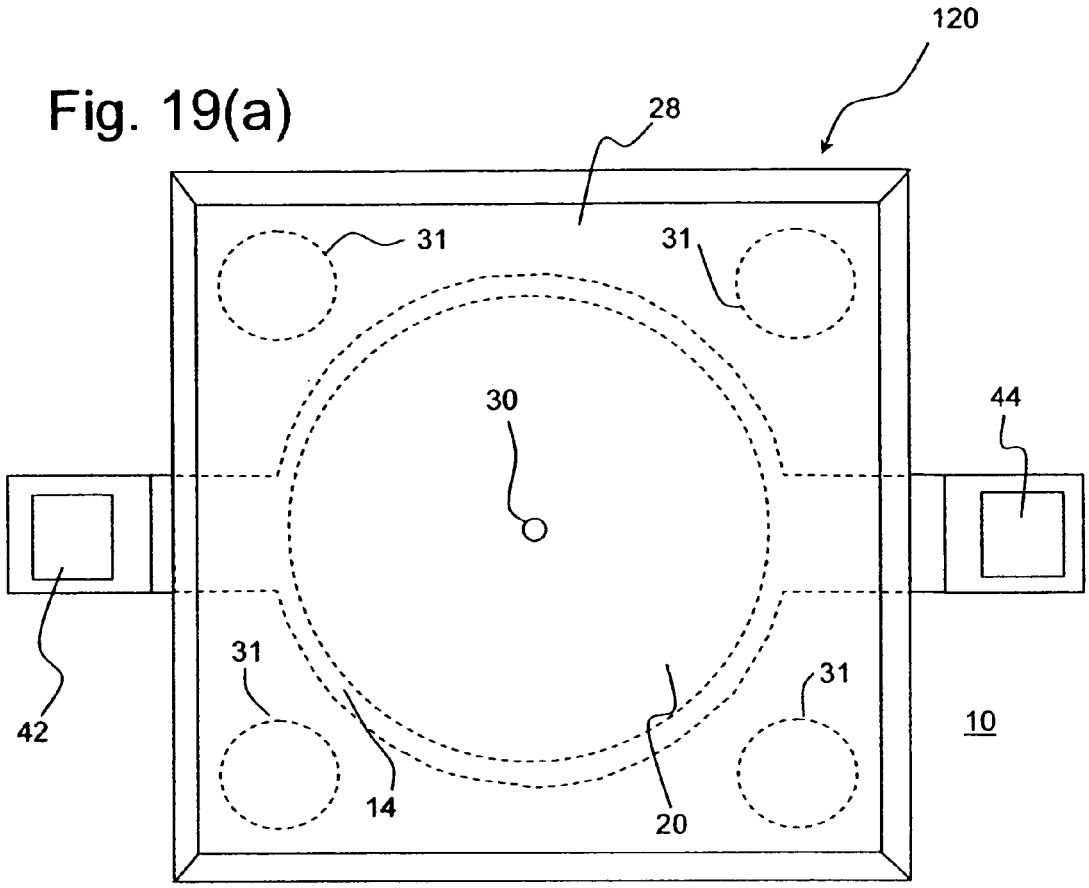
FIGS. 19(*a*) and 19(*b*) are plan views illustrating a normally closed microvalve having a deformable member which is anchored around a fully closed perimeter according to preferred embodiments of the present invention.
Figure 19B:
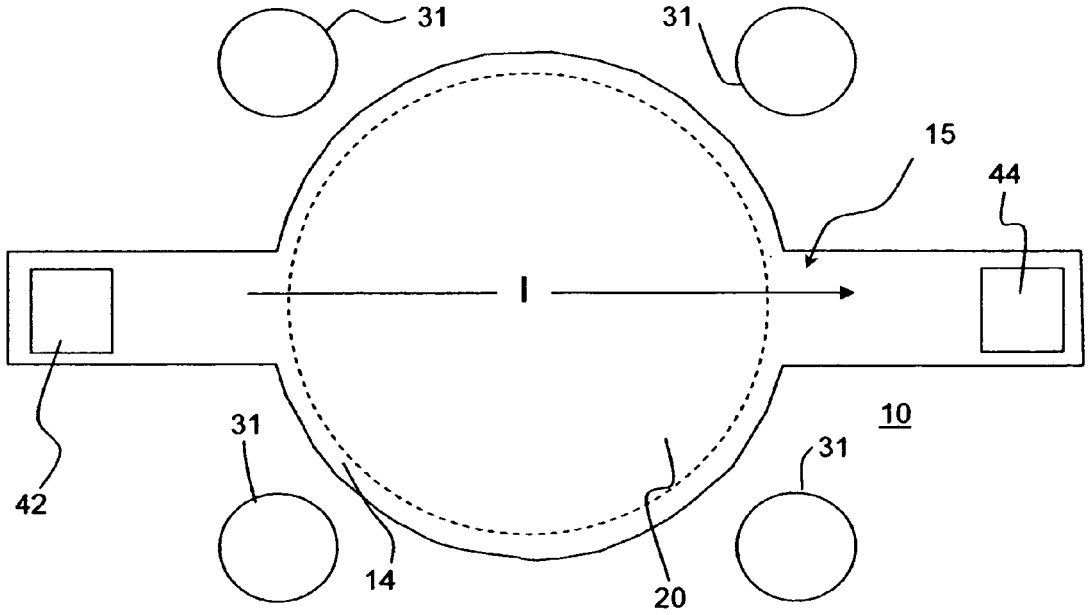

FIG. 19 illustrates in plan view a deformable element 20 configured as a circular laminate attached fully around its circular perimeter. Such a deformable element will buckle, or pucker, in a three-dimensional fashion. A fully attached perimeter configuration of the deformable element may be advantageous when it is undesirable to operate the deformable element immersed in a working fluid. Or, it may also be beneficial that the deformable element work against air, a vacuum, or other low resistance medium on one of its faces while deforming against the working fluid of the application impinging the opposite face.

FIG. 19(*a*) illustrates a liquid drop emitter having a square fluid upper chamber 28 with a central nozzle 30. Shown in phantom in FIG. 19(*a*), a circular deformable element 20 is connected to peripheral anchor edge 14. Deformable element 20 forms a portion of a bottom wall of a fluid chamber. Fluid enters the chamber via inlet ports 31. In FIG. 19(*b*) the upper chamber 28 is removed. The heat pulses are applied by passing current via heater electrodes 42 and 44 through an electrically resistive layer included in the laminate structure of deformable element 20.

FIG. 20 illustrates an alternative embodiment of the present inventions in which the deformable element is a circular laminate attached around the full circular perimeter. The deformable element forms a portion of a wall of a normally closed microvalve. The second layer 24 side of the deformable element has been configured to be accessible to light energy 39 directed by light collecting and focusing element 40. Fluid may enter the microvalve via inlet port 31. The valve is operated by directing a pulse of light energy of sufficient intensity to heat the deformable element through the appropriate temperature time profile to cause doubly-anchored buckling. The valve may be maintained in an open state by continuing to supply light energy pulses sufficient to maintain a sufficiently elevated temperature of the deformable element.

A light-activated device according to the present inventions may be advantageous in that complete electrical and mechanical isolation may be maintained while opening the microvalve. A light-activated configuration for a liquid drop emitter, microvalve, or other doubly-anchored thermal actuator may be designed in similar fashion according to the present inventions.

Figure 21:
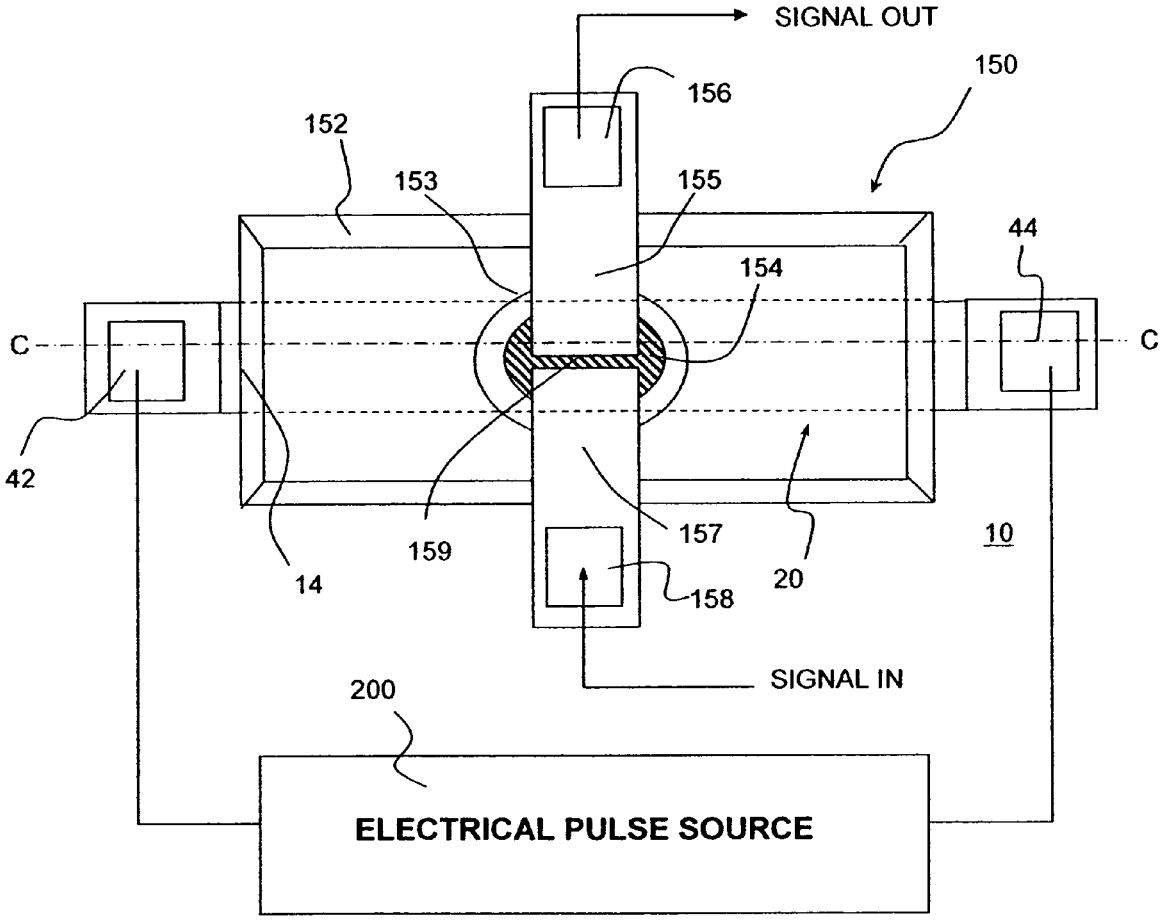
FIG. 21 is a plan view illustrating an electrical microswitch according to preferred embodiments of the present invention.
Figure 22A:
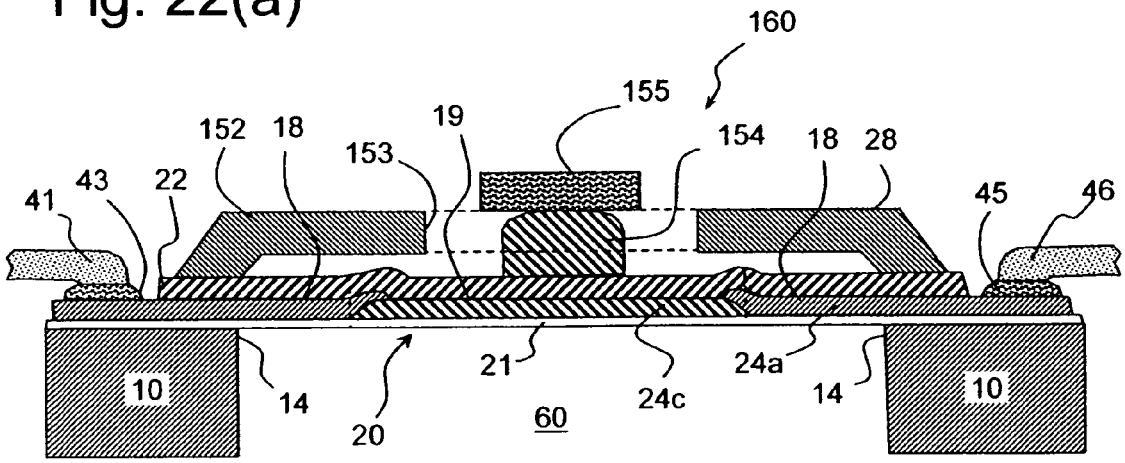
FIGS. 22(*a*) and 22(*b*) are side views illustrating the operation of a normally closed microswitch according to preferred embodiments of the present invention.
Figure 22B:
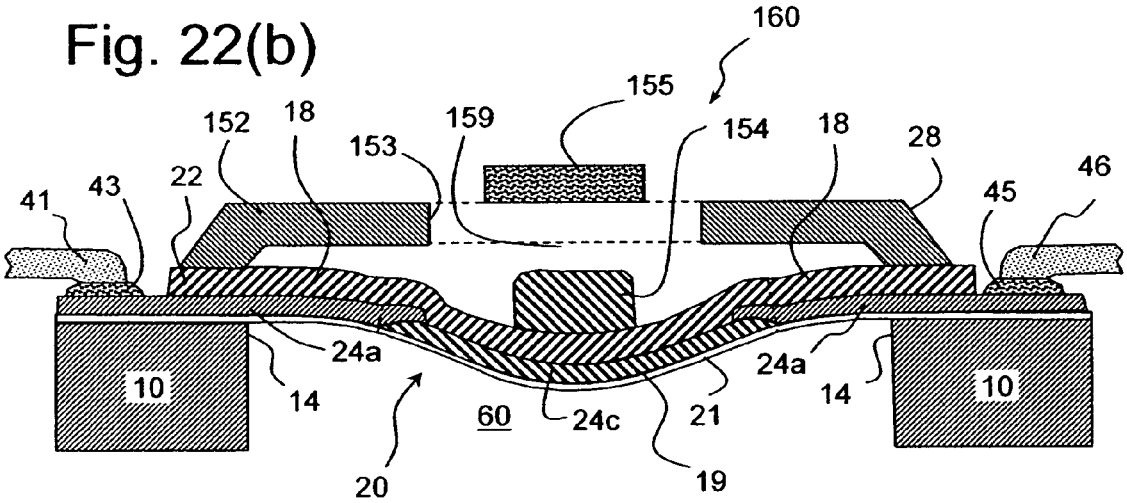

Doubly-anchored thermal actuators according to the present inventions are also useful in the construction of microswitches for controlling electrical circuits. A plan view of a microswitch unit 150 according to the present inventions is illustrated in FIG. 21. FIGS. 22(*a*) and 22(*b*) illustrate in side views a normally closed microswitch unit 160 configuration and FIGS. 23(*a*) and 23(*b*) illustrates in side view a normally open microswitch unit 170.

In the plan view illustration of FIG. 21, the deformable element 20 is heated by electroresistive means. Electrical pulses are applied by electrical pulse source 200 via heater electrodes 42 and 44. The microswitch controls an electrical circuit via first switch electrode 155 and second switch electrode 157. First switch electrode 155 and second switch electrode 157 are supported by a spacer support 152 in a position above the deformable element 20. A space 159 separates first and second switch electrodes 155, 157 so that an external circuit connected to switch input pads 156 and 158 is open unless the first and second switch electrodes are electrically bridged. A control electrode 154, beneath the first and second switch electrodes 155, 157 may be urged into bridging contact via electrode access opening 153 in spacing structure 152. Control electrode 154 is constructed of a highly conductive material. Deformable element 20 is positioned to move the control electrode towards or away from the first and second switch electrodes 155,157 as it is made to undergo buckling by the application of heat pulses.

A normally closed microswitch may be configured as illustrated in FIG. 22. The side views of FIG. 22 are formed along line C—C in FIG. 21. First layer 22 of the deformable element 20 urges control electrode 154 into contact with first switch electrode 155 and second switch electrode 157 (not shown) when the deformable element 20 is in its residual shape thereby closing the external circuit via input pads 156,158 (not shown). When a heat pulse is applied to deformable element 20 the microswitch opens to a maximum extent (FIG. 22(*b*) breaking the external circuit, i.e., opening the microswitch. The microswitch may be maintained in an open state by continuing to heat the deformable element sufficiently to maintain the upward buckled state.

Figure 23A:
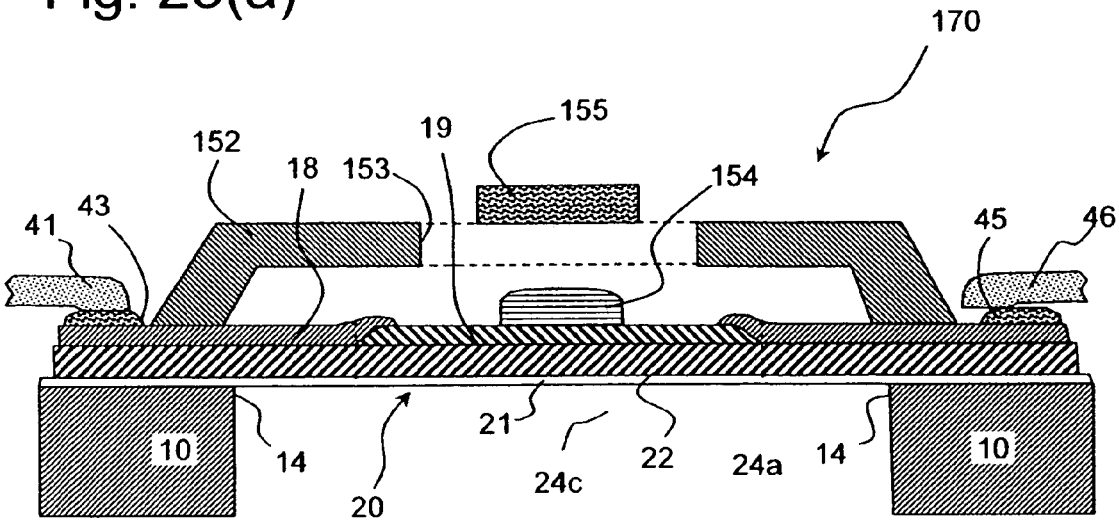
FIGS. 23(*a*) and 23(*b*) are side views illustrating the operation of a normally open microswitch according to preferred embodiments of the present invention.
Figure 23B:
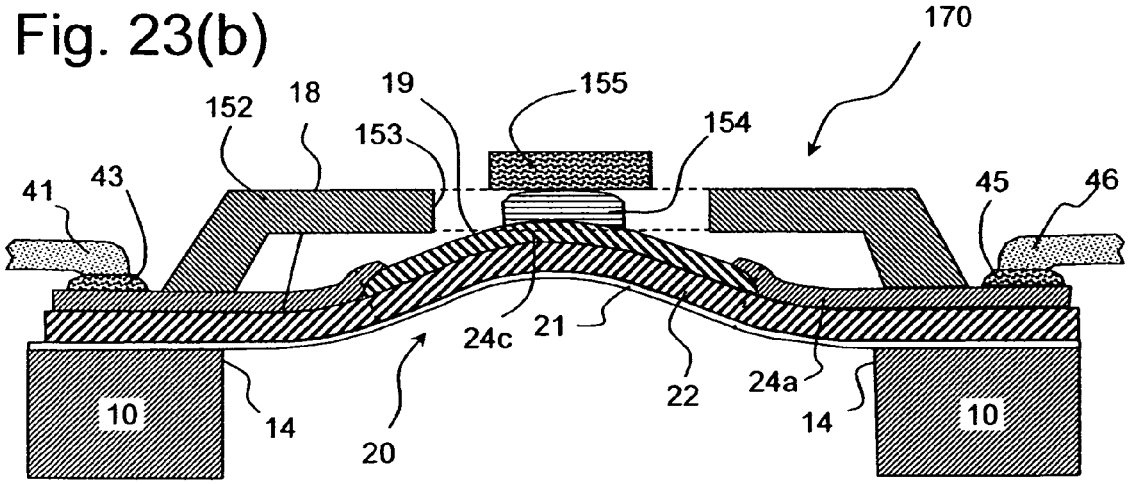

A normally open microswitch may be configured as shown in FIG. 23. The side views of FIG. 23 are formed along line C—C in FIG. 23. The deformable element 20 is positioned in close proximity to electrode access opening 159, sufficiently close so that after buckling the deformation is sufficient to urge control electrode 154 into bridging contact with first switch electrode 155 and second switch electrode 157 (not shown). When a heat pulse is applied to deformable element 20 the microswitch closes by urging control electrode 154 into electrical contact with first and second switch electrodes 155, 157. The microswitch may be maintained in a closed state by continuing to heat the deformable element sufficiently to maintain the upward buckled state. For embodiments of the present invention wherein second layer 24 is electrically resistive, an electrical insulation layer 151 may be provided under control electrode 154.

Figure 24:
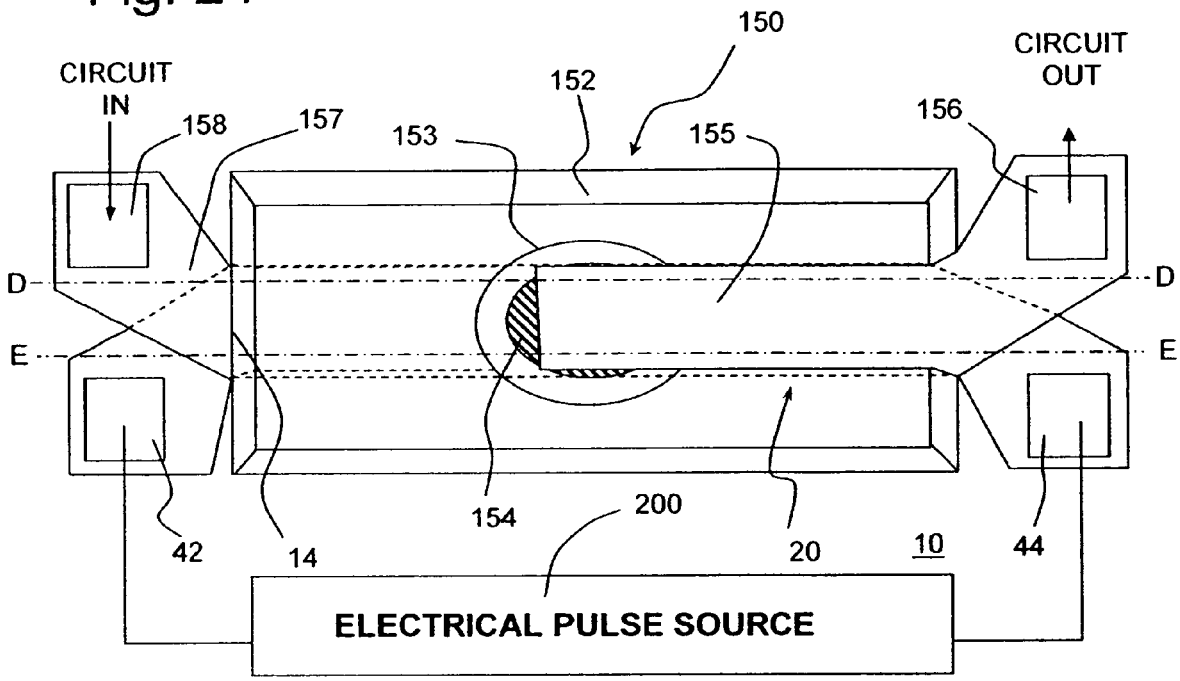
FIG. 24 is a plan view illustrating an alternate design for an electrical microswitch according to preferred embodiments of the present invention.

For the microswitch configurations illustrated in FIGS. 21–23, both the first and second switch electrodes are supported by the spacing structure 152 and the control electrode 154 make bridging contact with both to open or close the switch. An alternate microswitch configuration is illustrated in FIG. 24 wherein the second switch electrode 157 is formed onto the deformable element 20 and into permanent electrical contact with the control electrode 154. First switch electrode 155 is supported by spacing structure 152 and is accessible for contact by the control electrode via electrical access opening 153. In this illustrated embodiment of the present inventions, microswitch opening and closing therefore results from the deformable element 20 urging control electrode 154 into and out of contact with first switch electrode 155.

Figure 25A:
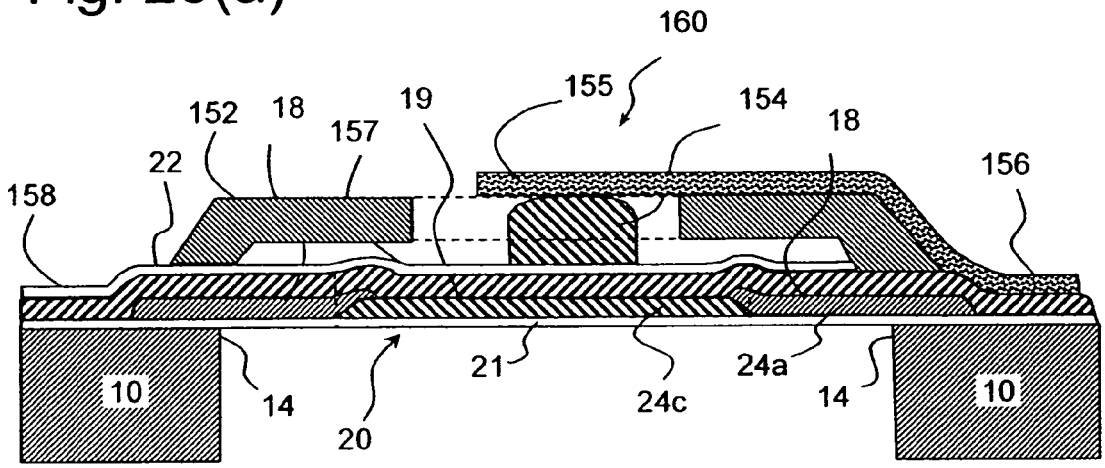
FIGS. 25(*a*) and 25(*b*) are side views illustrating the operation of a normally closed microswitch having the configuration of FIG. 24 according to preferred embodiments of the present invention.
Figure 25B:
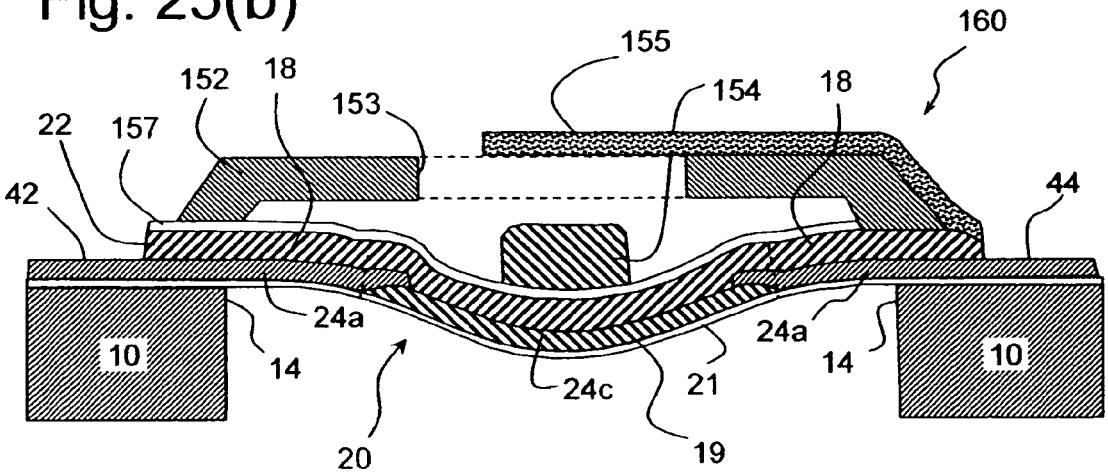

FIG. 24 illustrates in plan view the alternative microswitch unit 150 configuration having second switch electrode and control electrode 154 in permanent electrical contact. FIG. 25(*a*) illustrates a side view of a normally closed microswitch unit 160 according to this configuration of the present inventions. The FIG. 25(*b*) side view is formed along line D—D of FIG. 24 and shows the switch in a residual, normally closed state. In this view, external electrical circuit input leads 156 and 158 are seen but heater electrodes 42,44 attached to electroresistive means for heating the deformable element are not shown. FIG. 25(*b*) illustrates a side view of a normally closed microswitch unit 160 after a heat pulse has been applied and the deformable element has undergone buckling, opening a space 159 between control electrode 154 and first switch electrode 155, thereby opening external circuit. FIG. 25(*b*) is formed along line E—E in FIG. 24, and shows heater electrodes 42, 44 but not input leads 156,158.

The previously discussed illustrations of doubly-anchored thermal actuator microswitches have shown deformable elements in the shape of thin rectangular microbeams attached at opposite ends to opposing anchor edges. The long edges of the deformable elements were not attached and were free to move resulting in a two-dimensional buckling deformation. Alternatively, a deformable element for a microswitch may be configured as a plate attached around a fully closed perimeter as was illustrated in FIG. 19 above for a microvalve. A fully attached perimeter configuration of the deformable element may be advantageous when is undesirable to operate the deformable element in a vacuum, or other low resistance gas on the face opposite to the control electrode.

Figure 26A:
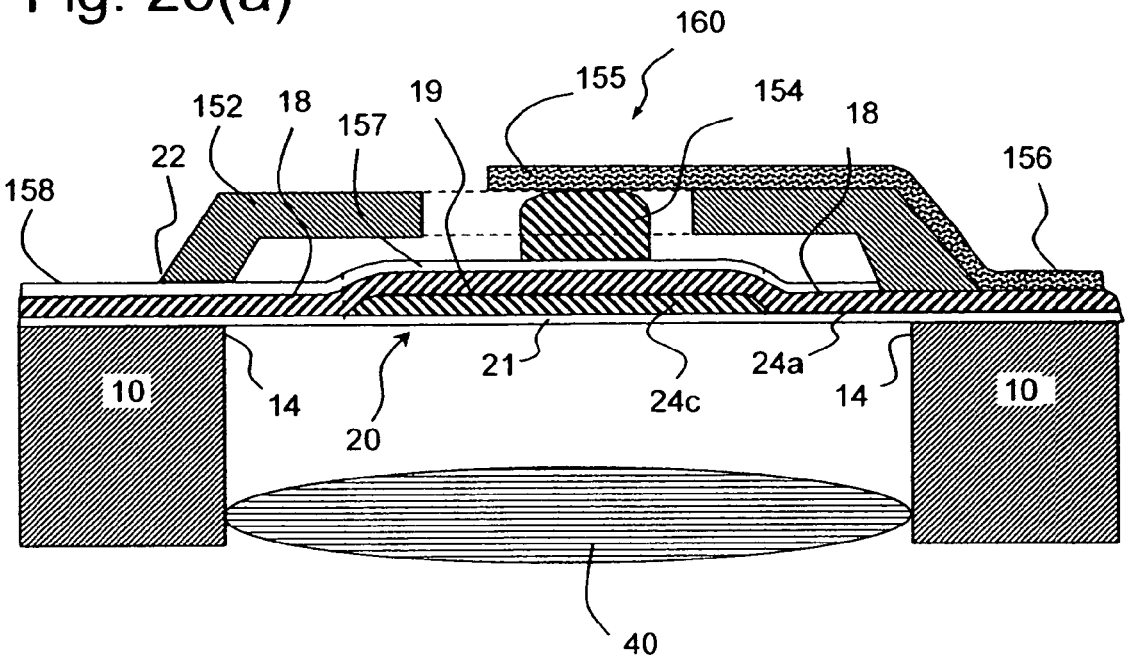
FIGS. 26(*a*) and 26(*b*) are side views illustrating the operation of a normally closed microswitch operated by light energy heating pulses according to preferred embodiments of the present invention.
Figure 26B:
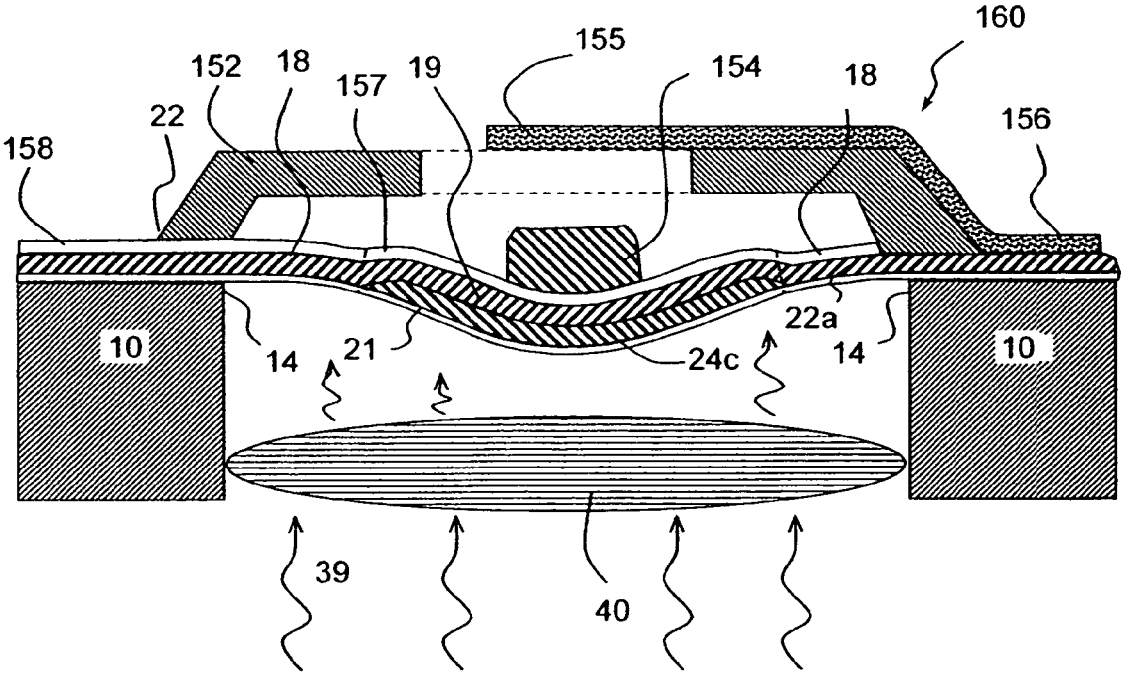

FIG. 26 illustrates in side view an alternative embodiment of a normally closed microswitch unit 160 in which the deformable element is a circular laminate attached around the full circular perimeter. The second layer 24 side of the deformable element has been configured to be accessible to light energy 39 directed by light collecting and focusing element 40. The microswitch is operated by directing a pulse of light energy of sufficient intensity to heat the deformable element to cause doubly-anchored buckling. The microswitch may be maintained in an open state by continuing to supply light energy pulses sufficient to maintain a sufficiently elevated temperature of the deformable element.

A light-activated device according to the present inventions may be advantageous in that complete electrical and mechanical isolation may be maintained while opening the microswitch. A light-activated configuration for a normally open microswitch may be designed in similar fashion according to the present inventions.

Figure 27:
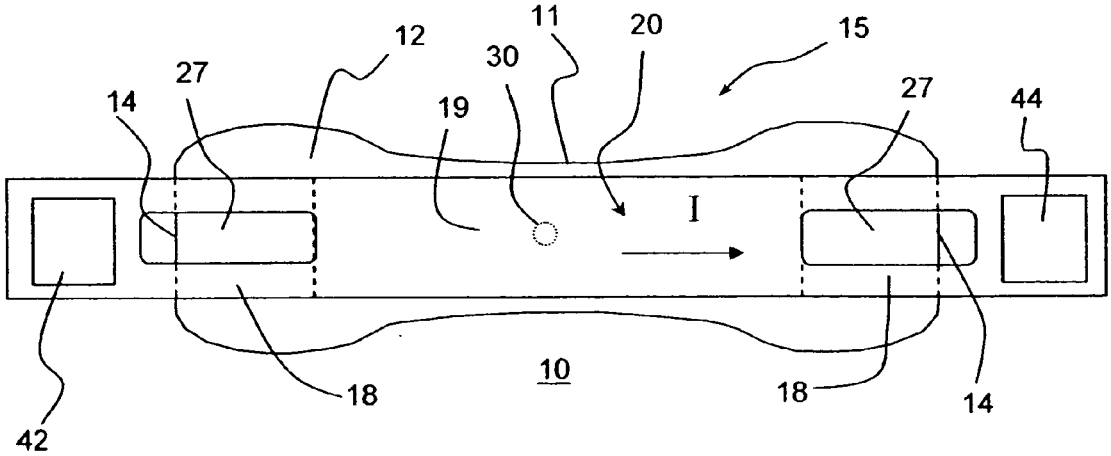
FIG. 27 illustrates in plan view a doubly-anchored thermal actuator having anchor portions of the deformable element that are effectively narrowed in width to reduce the anchor portion flexural rigidity.

FIG. 27 illustrates in plan view an alternative design for reducing the flexural rigidity of a deformable element 20 in anchor portion 18. Material has been removed from one or more layers of deformable element 20 in the anchor portions as illustrated by slots 27. Removing material in this fashion reduces flexural rigidity by reducing the effective width of the beam structure in anchor portion 18 as compared to central portion 19 of the deformable element 20.

Figure 28:
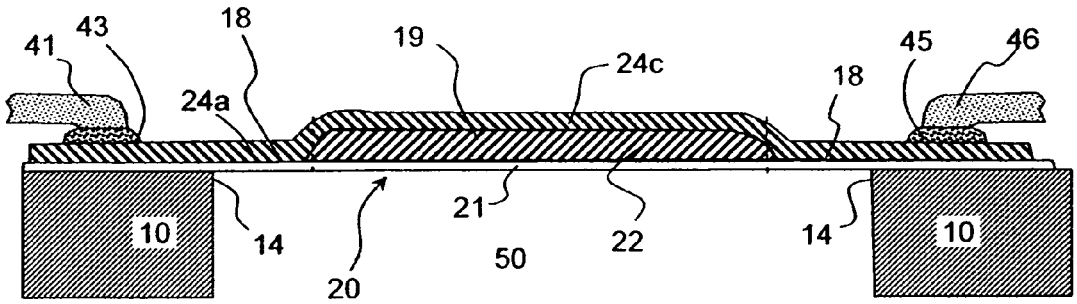
FIG. 28 illustrates in side view a doubly-anchored thermal actuator having anchor portions of the deformable element that are effectively thinned to reduce the anchor portion flexural rigidity.

FIG. 28 illustrates in side view an alternative design for reducing the flexural rigidity of a deformable element 20 in anchor portion 18. For the illustrated doubly-anchored thermal actuator first layer 22 is entirely removed in the anchor portion. Removing material in this fashion substantially reduces flexural rigidity by reducing both the effective thickness and the effective Young's modulus in the anchor portions 18.

The Figures herein depict the rest shape of the deformable element 20 as being flat, lying in a central plane. However, due to fabrication process effects or operation from an elevated or depressed temperature, the rest shape of the deformable element may be bowed away from the central plane. The present inventions contemplate and include this variability in the rest shape of the deformable element 20.

While much of the foregoing description was directed to the configuration and operation of a single doubly-anchored thermal actuator, liquid drop emitter, microvalve, or microswitch, it should be understood that the present invention is applicable to forming arrays and assemblies of such single device units. Also it should be understood that doubly-anchored thermal actuator devices according to the present invention may be fabricated concurrently with other electronic components and circuits, or formed on the same substrate before or after the fabrication of electronic components and circuits.

Further, while the foregoing detailed description primarily discussed doubly-anchored thermal actuators heated by electrically resistive apparatus, or pulsed light energy, other means of generating heat pulses, such as inductive heating, may be adapted to apply heat pulses to the deformable elements according to the present invention.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
11 liquid chamber narrowed wall portion
12 liquid chamber
12*c* narrowed central portion of liquid chamber 12
13 flexible joint material
14 opposing anchor edges at deformable element anchor point
15 doubly-anchored thermal actuator according to the present inventions
16 free edge portion of the deformable element
17 relief portion of the base element
18 anchor portion of the deformable element
19 central portion of the deformable element
20 deformable element
20*b* fixed portion of deformable element 20 bonded to substrate 10
21 passivation and or etch stop masking layer
22 first layer
24 second layer
24*a* anchor portion of the second layer
24*c* central portion of the second layer
26 third layer
27 slots removing deformable element material in the anchor portions
28 liquid chamber structure, walls and cover
29 sacrificial layer
30 nozzle
31 fluid inlet port
32 fluid flow port
34 fluid inlet path
36 valve seat
38 valve sealing member
39 light energy
40 light directing element
41 TAB lead
42 heater electrode
43 solder bump

44 heater electrode
45 solder bump
46 TAB lead
47 electroresistive element, thin film heater resistor
50 drop
52 fluid stream
60 fluid
62 etchable region
80 mounting structure
90 doubly-anchored thermal actual of conventional design
100 ink jet printhead
110 drop emitter unit
120 normally closed microvalve unit
130 normally open microvalve unit
150 microswitch unit
151 electrical insulation layer under control electrode
152 spacing structure
153 electrode access opening
154 control electrode
155 first switch electrode
156 input pad to first switch electrode
157 second switch electrode
158 input pad to second switch electrode
159 space between first and second switch electrodes
160 normally closed microswitch unit
170 normally open microswitch unit
200 electrical pulse source
300 controller
400 image data source
500 receiver

The invention claimed is:

1. A normally closed fluid microvalve for controlling a pressurized fluid comprising:

(a) a chamber, formed in a substrate, and having a fluid flow port;

(b) opposing anchor edges supported from the substrate;

(c) a deformable element attached to the opposing anchor edges and having a central portion urged sealably against the fluid flow port, the deformable element constructed as a planar lamination including a first layer of a first material having a low coefficient of thermal expansion and a second layer of a second material having a high coefficient of thermal expansion, the deformable element having anchor portions adjacent the anchor edges and the central portion between the anchor portions wherein the flexural rigidity of the anchor portions is substantially less than the flexural rigidity of the central portion; and (d) apparatus adapted to apply a heat pulse to the deformable element, causing a sudden rise in the temperature of the deformable element, the deformable element bowing in a direction away from the fluid flow port, opening the fluid flow port permitting the pressurized fluid to flow through the fluid flow port, and then relaxing, sealing the fluid flow port as the temperature decreases thereof.

2. The normally closed fluid microvalve of claim 1 wherein the apparatus adapted to apply a heat pulse to the deformable element comprises an electroresistive element in good thermal contact with the deformable element.

3. The normally closed fluid microvalve of claim 1 wherein the second material is an electrically resistive material and the apparatus adapted to apply a heat pulse to the deformable element comprises a pair of heater electrodes connected to the second layer to allow an electrical current to be passed through a portion of the second layer.

4. The normally closed fluid microvalve of claim 3 wherein the second material is titanium aluminide.

5. The normally closed fluid microvalve of claim 1 wherein the apparatus adapted to apply a heat pulse to the deformable element comprises light directing elements to allow light energy pulses to impinge the deformable element.

6. The normally closed fluid microvalve of claim 1 wherein the effective Young's modulus of the anchor portions is $E_a$, the effective Young's modulus of the central portion is $E_c$, and $E_a$ is substantially less than $E_c$.

7. The normally closed fluid microvalve of claim 1 wherein the effective thickness of the anchor portions is $h_a$, the effective thickness of the central portion is $h_c$, and $h_a$ is substantially less than $h_c$.

8. The normally closed fluid microvalve of claim 7 wherein the thickness of the first layer in the anchor portions is substantially less than the thickness of the first layer in the central portion.

9. The normally closed fluid microvalve of claim 1 wherein the effective width of the anchor portions is $w_a$, the effective width of the central portion is $w_c$, and $w_a$ is substantially less than $w_c$.

10. The normally closed fluid microvalve of claim 1 wherein the deformable element has a characteristic length 2L, the anchor portions have a characteristic length $L_a$, and $\frac{1}{4}L \leqq L_a \leqq \frac{1}{2}L$.

11. The normally closed fluid microvalve of claim 1 wherein the first material is an electrically insulative material.

12. The normally closed fluid microvalve of claim 11 wherein the electrically insulative material is silicon nitride, silicon oxide, silicon carbide or any combination thereof.

13. The normally closed fluid microvalve of claim 1 further comprising a third layer of a third material that overlies the second layer wherein the third material is electrically insulative.

14. The normally closed fluid microvalve of claim 13 wherein the third material is an organic polymer.

15. The normally closed fluid microvalve of claim 1 wherein the opposing anchor edges form a closed perimeter and all edges of the deformable element are attached to the anchor edges.

16. The normally closed fluid microvalve of claim 1 wherein a free edge portion of the deformable element is not attached to the anchor edges.

17. A normally open fluid microvalve for controlling a pressurized fluid comprising:

(a) a chamber, formed in a substrate, and having a fluid flow port;

(b) opposing anchor edges supported from the substrate, said anchor edges defining a central plane;

(c) a deformable element attached to the opposing anchor edges and having a central portion in close proximity to the fluid flow port permitting flow of the pressurized fluid through the fluid flow port, the deformable element constructed as a planar lamination including a first layer of a first material having a low coefficient of thermal expansion and a second layer of a second material having a high coefficient of thermal expansion, the deformable element having anchor portions adjacent the anchor edges and the central portion between the anchor portions wherein the flexural rigidity of the anchor portions is substantially less than the flexural rigidity of the central portion; and (d) apparatus adapted to apply a heat pulse to the deformable element, causing a sudden rise in the temperature of the deformable element, the deformable element bowing in a direction toward the fluid flow port, contacting and sealing the fluid flow port stopping flow through the fluid flow port, and then relaxing, opening the fluid flow port as the temperature decreases thereof.

18. The normally open fluid microvalve of claim 17 wherein the apparatus adapted to apply a heat pulse to the deformable element comprises an electroresistive element in good thermal contact with the deformable element.

19. The normally open fluid microvalve of claim 17 wherein the second material is an electrically resistive material and the apparatus adapted to apply a heat pulse to the deformable element comprises a pair of heater electrodes connected to the second layer to allow an electrical current to be passed through a portion of the second layer.

20. The normally open fluid microvalve of claim 19 wherein the second material is titanium aluminide.

21. The normally open fluid microvalve of claim 17 wherein the apparatus adapted to apply a heat pulse to the deformable element comprises light directing elements to allow light energy pulses to impinge the deformable element.

22. The normally open fluid microvalve of claim 17 wherein the effective Young's modulus of the anchor portions is $E_a$, the effective Young's modulus of the central portion is $E_c$, and $E_a$ is substantially less than $E_c$.

23. The normally open fluid microvalve of claim 17 wherein the effective thickness of the anchor portions is $h_a$, the effective thickness of the central portion is $h_c$, and $h_a$ is substantially less than $h_c$.

24. The normally open fluid microvalve of claim 23 wherein the thickness of the first layer in the anchor portions is substantially less than the thickness of the first layer in the central portion.

25. The normally open fluid microvalve of claim 17 wherein the effective width of the anchor portions is $w_a$, the effective width of the central portion is $w_c$, and $w_a$ is substantially less than $w_c$.

26. The normally open fluid microvalve of claim 17 wherein the deformable element has a characteristic length 2L, the anchor portions have a characteristic length $L_a$, and $\frac{1}{4}L \leqq L_a \leqq \frac{1}{2}L$.

27. The normally open fluid microvalve of claim 17 wherein the opposing anchor edges form a closed perimeter and all edges of the deformable element are attached to the anchor edges.

28. The normally open fluid microvalve of claim 17 wherein a free edge portion of the deformable element is not attached to the anchor edges.

29. The normally open fluid microvalve of claim 17 further comprising a valve sealing member bonded to the central portion of the deformable member opposite the fluid flow port wherein the valve sealing member is pressed against the fluid flow port after the application of the heat pulse forming a seal against the pressurized fluid.

30. The normally open fluid microvalve of claim 29 further comprising a valve seat formed at the fluid flow port, the valve seat receiving the valve sealing member thereby forming a seal against the pressurized fluid.

31. The normally open fluid microvalve of claim 17 wherein the first material is an electrically insulative material.

32. The normally open fluid microvalve of claim 31 wherein the electrically insulative material is silicon nitride, silicon oxide, silicon carbide or any combination thereof.

33. The normally open fluid microvalve of claim 17 further comprising a third layer of a third material that overlies the second layer wherein the third material is electrically insulative.

34. The normally open fluid microvalve of claim 33 wherein the third material is an organic polymer.

* * * * *